US005351103A

United States Patent [19]

Komatsu et al.

[11] Patent Number: 5,351,103

[45] Date of Patent: Sep. 27, 1994

[54] AUTOMATIC DEVELOPING MACHINE FOR SILVER HALIDE PHOTOGRAPHIC LIGHT-SENSITIVE MATERIALS

[75] Inventors: Yoshimasa Komatsu; Shigeharu Koboshi; Masao Ishikawa, all of Hino, Japan

[73] Assignee: Konica Corporation, Tokyo, Japan

[21] Appl. No.: 940,945

[22] PCT Filed: Apr. 30, 1992

[86] PCT No.: PCT/JP92/00566

§ 371 Date: Oct. 27, 1992

§ 102(e) Date: Oct. 27, 1992

[87] PCT Pub. No.: WO92/20013

PCT Pub. Date: Dec. 11, 1992

[30] Foreign Application Priority Data

May 1, 1991 [JP] Japan ..... 3-128401
May 17, 1991 [JP] Japan ..... 3-141425
May 21, 1991 [JP] Japan ..... 3-146757

[51] Int. Cl.[5] ..... G03D 3/02

[52] U.S. Cl. ..... 354/324; 430/398; 430/450

[58] Field of Search ..... 354/298, 319–324; 430/398, 450, 458, 465

[56] References Cited

U.S. PATENT DOCUMENTS 4,705,379 11/1987 Kobayashi et al. ..... 354/324
4,839,273 6/1989 Yamada et al. ..... 430/634
5,240,822 8/1993 Tanaka et al. ..... 430/450

FOREIGN PATENT DOCUMENTS 62-273537(A) 11/1987 Japan .
63-88548 4/1988 Japan .

*Primary Examiner*—D. Rutledge
*Attorney, Agent, or Firm*—Frishauf, Holtz, Goodman & Woodward

[57] ABSTRACT

A compact automatic developing machine for silver halide photographic light-sensitive materials with improved operability which makes it easy to reduce the replenishing rate and which offers stable photographic performance, comprises at least one processing tank for containing a processing solution for processing an exposed silver halide photographic light-sensitive material. A solid processing agent is stocked and supplied to the processing tank, information on the amount of processing of the silver halide photographic light-sensitive materials is detected, and the supply of the solid processing agent is controlled according to the detected information on the amount of processing of the silver halide photographic light-sensitive material. The solid processing agent is preferably in the form of tablets which contain all components necessary to process the light-sensitive silver halide photographic material.

35 Claims, 13 Drawing Sheets

AUTOMATIC DEVELOPING MACHINE FOR SILVER HALIDE PHOTOGRAPHIC LIGHT-SENSITIVE MATERIALS

FIELD OF THE INVENTION

The present invention relates to an automatic developing machine for silver halide photographic light-sensitive materials, and more specifically a compact automatic developing machine with improved operability which offers dramatically improved chemical stability and which makes it easy to lower the replenishing rate.

BACKGROUND OF THE INVENTION

Silver halide photographic light-sensitive materials (hereinafter also referred to as light-sensitive materials or photographic materials) are processed by developing, desilvering, washing, stabilizing and other processes after exposure. A black-and-white developer or a color developer, a bleacher, a bleach-fixer or a fixer, tap water or deionized water, and a stabilizer are used for development, desilvering, washing and stabilization, respectively.

These liquids capable of performing the respective processes are generically called processing solutions. Each processing solution is usually kept at a temperature of 30° to 40° C., in which the light-sensitive material is immersed and processed.

These processes are usually carried out by sequentially transporting the light-sensitive material through processing tanks containing the above processing solutions, using an automatic developing machine or another means.

The automatic developing machine mentioned herein generally means a developing machine having a developing portion, a desilvering portion, a washing or stabilizing portion, a drying portion and a means for sequentially and automatically transporting the photographic light-sensitive material to each processing tank.

In processing using such an automatic developing machine, it is common practice to replenish the processing solution in each processing tank to keep the activity thereof constant.

Specifically, processing is carried out while supplying a replenisher from a replenisher tank to the processing tank as appropriate and necessary.

In this case, it is the common practice to prepare the replenisher itself (to be stored in the replenisher tank) in a separate place and supply it to the replenisher tank where necessary; traditionally, the replenisher has been prepared manually as follows.

The silver halide photographic light-sensitive material processing agent (hereinafter also referred to as photographic processing agent) is commercially available in the form of powder or liquid. It is manually prepared as a solution in a given amount of water in the case of powder. In the case of liquid, it is diluted with water to a given volume and transferred to the replenisher tank before use, since it is available in a concentrated state.

Replenisher tanks may be set next to the automatic developing machine, requiring considerable space. Also, in recently-increasing mini-labs, replenisher tanks are housed in the automatic developing machine; in this case as well, sufficient space must be available for the replenisher tanks.

Any processing agent replenisher is divided into several parts to ensure constantly good performance in photographic processing. For example, the color bleach-fixer replenisher is divided into two parts: the part of the oxidant ferric salt of organic acid and the part of the reducing agent thiosulfate. In preparing the replenisher, said dense part of ferric salt of organic acid and said dense part of thiosulfate are mixed together and diluted with a given amount of water before use.

Said dense parts are placed in containers such as plastic containers, which containers are packed in outer packages such as corrugated cardboard boxes for 1 unit of commercial distribution.

The processing agent replenisher kit of said part agents is dissolved, diluted, mixed and then diluted to a given volume before use. Said processing agent replenisher has the following drawbacks. First, the part agents are separately put into respective containers; some kits of processing agent replenisher comprise several bottles of part agents so that 1 unit of commercial distribution thereof means a considerable number of containers, which requires much space in storing and transporting them. For example, the color developer replenisher for CPK-2-20QA, a processing solution for color printing paper, is available in 10-liter units, wherein part A (a kit including a preservative), part B (a kit including a color developing agent) and part C (alkaline agent) are each contained in a 500-ml plastic container. Similarly, the bleach-fixer replenisher is available in 8-liter units, wherein 3 part agents are contained in respective bottles. The stabilizer replenisher is available in 10-liter units, wherein 2 part agents are contained in respective bottles. These replenishers are stored and transported in respective outer packages of various sizes. The outer package size ranges from about 17 cm×14 cm×16.5 cm for the stabilizer replenisher to about 18.5 cm×30.5 cm×22.5 cm for the bleach-fixer replenisher; it is not possible to pile packages of replenishers in storing or transporting them or stocking them in dealer shops unless they are of the same kind so that much space is required afterall.

The second drawback is concerned with the problem of disposal of waste containers. In recent years, there has been strong demand for environmental conservation and saving resources mainly in Europe and the United States; in the photographic industry, plastic containers have been of major concern. Specifically, although plastic containers for photographic use are cheap, conveniently storable and transportable and excellent in chemical resistance, they pose problems of accumulation in the environment because they are hardly biodegradable, and generation of large amounts of carbon dioxide upon burning, which contribute to global warming and acid rain. As for the problems posed on the user side, they include decrease in the available working area due to occupation of the narrow working space by crowding plastic containers, which are too tough to compress.

The third drawback is poor chemical stability. For example, in preparing a color developer replenisher for color printing paper, a given volume of water is placed in the replenisher tank, after which dense kit A, which contains a preservative, is added, followed by stirring, and subsequently dense kit B, which contains a color developing agent, is added, followed by stirring, and then dense kit C, which contains an alkaline agent, is added, followed by stirring, and finally water is added to make a given volume. This series of procedures are liable to be accompanied by some problems. For example, in case of insufficient stirring or the user's failure to add the starting water, the color developing agent tends to separate crystals, which can stay in the bellows pump and fail to be supplied so that the photographic performance becomes labile or the bellows pump breaks. Also, the dense kits are not always used immediately after production; they may be used even 1 year after production; in some cases, the performance of the color developing agent or preservative becomes labile due to oxidation.

The color developer replenisher prepared from dense kits or powder is also known to pose some problems in the replenisher tank. For example, if the replenisher remains unused for a long time, crystals can deposit on the inside wall of the replenisher tank, the replenisher becomes susceptible to oxidation, and tar forms. Under some storage conditions, other problems arise, including separation of easily-crystallizing components of the replenisher, such as the color developing agent, at low temperatures; some makers specify replenisher storage conditions and instruct the users to keep their replenisher under those conditions.

As stated above, when a replenisher, e.g., one for color developer for color printing paper, is prepared using a dense kit or powder used commonly, the above-mentioned problems arise; similar problems arise in the case of bleach-fixer, bleacher and fixer.

On the other hand, in addition to the above method of preparing a replenisher using a dense kit or powder, another method is known wherein a dense kit is added as such.

In this method, supplying means such as a bellows pump are used to supply the dense kit as such to the processing tank and a given volume of water is added independently, to improve the low efficiency in dissolving operation. This method certainly obviates solution preparing operation and is free from the problem of poor storage stability because no replenisher solution is prepared, in comparison with the above method, wherein the replenisher is prepared from a dense kit or powder.

However, this method also has many problems. The major problem is size increase in the automatic developing machine because of the necessity for a dense kit tank for supplying the dense kit and a pump as a means of supplying the dense kit. For example, in the case of CPK-2-20, a processing solution for color printing paper, the dense kit of color developer replenisher is divided into 3 parts; the dense kit of bleach-fixer replenisher, into 3 parts; the dense kit of stabilizer replenisher, into 2 parts. To supply all of these dense kits, 8 tanks and 8 pumps are required. In the conventional replenishing method, 3 tanks and 3 pumps for respective replenishers were sufficient. In short, more tanks and more pumps than in the conventional method are required for supplying the dense kits, and a pump for water used to replenisher solutions is also required.

Moreover, dense kits are difficult to maintain due to proneness to crystallization near the outlet of replenisher nozzles because they are dense solutions. Another problem is that the bellows pump is insufficient in supplying accuracy so that replenishing accuracy fluctuates widely in supplying a dense replenisher, resulting in very labile photographic performance. Still another problem is that the amount of waste plastic containers remains unchanged in comparison with the conventional replenishing method even when dense kits are supplied.

In addition to the above methods, some proposals have been made to obviate the use of plastic containers and improve chemical stability.

For example, Japanese Patent Publication Open to Public Inspection (hereinafter referred to as Japanese Patent O.P.I. Publication) No. 11032/1983 discloses an art wherein developing components are encapsuled in microcapsules; Japanese Patent O.P.I. Publication No. 61837/1976 discloses photographic tablets containing a disintegrating agent. Japanese Patent O.P.I. Publication Nos. 109042/1990, 109043/1990, 39735/1991 and 39739/1991 disclose methods using granular photographic processing agents having a particular average grain size.

The photographic tablets containing a disintegrating agent described in Japanese Patent O.P.I. Publication No. 61837/1976 are nothing more than easily-soluble tablets.

Japanese Patent O.P.I. Publication No. 109042/1990 describes a granular photographic processing agent having a particular average grain size.

However, none of these publications proposes an automatic developing machine which has sufficiently simplified operability and offers stable photographic performance or a compact automatic developing machine having no replenisher tanks.

On the other hand, as a means of obviating the necessity for dissolving operation, Japanese Patent O.P.I. Publication No. 11344/1991 discloses an art wherein pasty part agents, in amounts according to the mixing ratio of the part agents, are pushed out from respective unit containers and appropriately diluted to accurately prepare and supply replenishers. Although this method certainly reduces or almost obviates the necessity for dissolving operation, the pasty part agents are difficult to push out in given amounts for long periods, and in addition, when they are not used frequently, nozzle clogging tends to occur, which hampers constant photographic performance. Also, paste containers are required, which must be made of flexible and tough material; it is a common practice to use composite material, which is usually difficult to reuse and hence undesirable from the viewpoint of environmental protection.

Japanese Patent O.P.I. Publication No. 123942/1980 discloses a replenisher supplying apparatus for photographic developing process for supplying powder, liquid and diluent water, but it gives no description of a processing agent replenishment controlling means for keeping photographic performance constant.

Japanese Utility Model Publication No. 85732/1989 discloses an automatic developing machine having a means of adding a tablet fungicide to the stabilizer, but this publication also gives no description of a processing agent replenishment controlling means, and in addition, said means is not an essential component, since its purpose is to preserve the stabilizer itself.

SUMMARY OF THE INVENTION

It is an object of the present invention to realize a compact automatic developing machine. It is another object of the present invention to obviate the necessity for manual dissolving operation. It is still another object of the present invention to provide a photographic processing system offering stable photographic performance. It is yet another object of the present invention to provide an environmentally friendly system permitting reduction or avoidance of the use of plastic containers.

Figure 1:
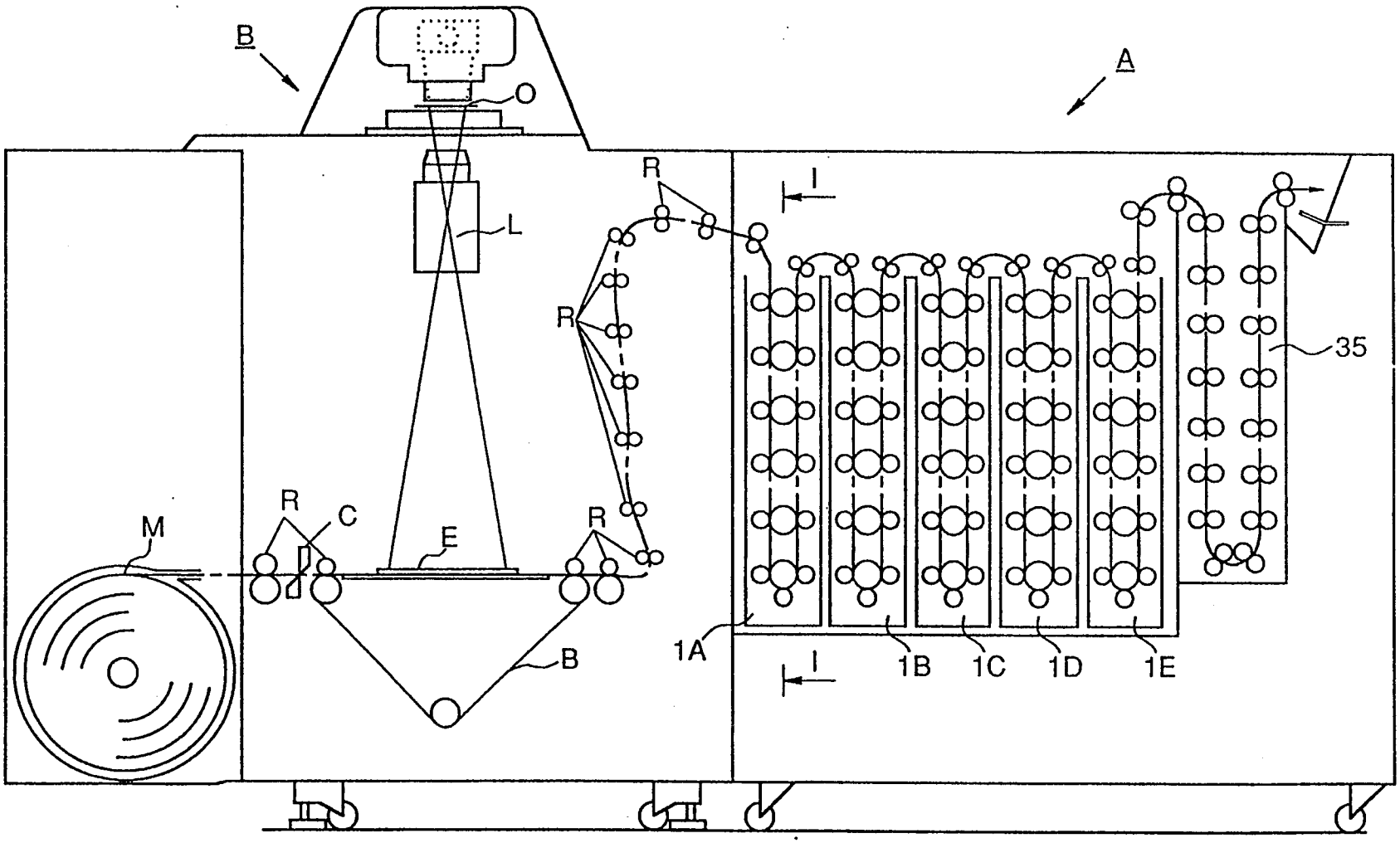
FIG. 1 is a schematic diagram of a printer processor wherein an automatic developing machine and photographic printer B are unified.

In these figures, the numerical symbols denote the following:

1: Processing tank
1A through 1E: Processing tank
1R: Rack
2: Processing portion
3: Filter
4: Circulatory pipe
5: Circulatory pump
6: Waste liquid discharge pipe
7: Heater
8: Processing amount information detecting means
9: Processing agent supply controlling means
10: Pusher
11: Solid processing agent receiving portion
12: Separating wall
13: Tablet
13': Solid photographic processing agent
14: Filtering means
14A: Impeller blade
14B: Impeller blade
14C: Shearing gear
14D: Vibrator
14E: Magnetic rotary blade
14F: Rotary magnet
14L: Transmission
14M: Motor
14N: Partition material
14P: Jet pump
15: Cartridge
16: Lead
17: Processing agent supplying means
17': Processing agent supplying portion
18: Pusher claw
19: Cam
19': Pinion gear
21: Tablet pusher spring
23: Liquid level fall detecting means
24: Tablet stopper
25: Screw
27: Screw
28: Container
29: Processing agent guide
32: Warm water supplier
33: Electromagnetic valve
35: Drying portion
36: Water replenisher supplying pipe
101: Pipe (for water replenisher supply)
102: Water replenishing means
103: Water replenisher tank

DETAILED DESCRIPTION OF THE INVENTION

The present inventors made investigations and found that the problems described above can be solved by the following configurations.

The inventors found that the above objects of the invention can be accomplished by an automatic developing machine for silver halide photographic light-sensitive materials having at least one processing tank for containing a processing solution for processing an exposed silver halide photographic light-sensitive material, a means of stocking a solid processing agent, a means of supplying the solid processing agent to at least one of said processing tanks, a means of detecting information on the amount of processing of said silver halide photographic light-sensitive material, and a means of controlling said supplying means according to information on the amount of processing of said silver halide photographic light-sensitive material detected by said detecting means.

The inventors also found that the above objects can also be accomplished by another mode of embodiment of the present invention, namely an automatic developing machine for silver halide photographic light-sensitive materials having a processing tank for containing a processing solution for processing an exposed silver halide photographic light-sensitive material, a means of stocking a solid processing agent, a means of supplying the solid processing agent to at least one of said processing tanks, a means of detecting information on the amount of processing of said silver halide photographic light-sensitive material, a means of controlling said supplying means according to information on the amount of processing of said silver halide photographic light-sensitive material detected by said detecting means, and a means of supplying a water replenisher to said processing tank.

Other preferred modes of embodiment of the present invention are such automatic developing machines wherein said solid processing agent is in a tablet form, said solid processing agent has been formed by tableting after granulation, said solid processing agent contains all the components necessary to process said silver halide photographic light-sensitive material, the processing tank to which said solid processing agent is supplied comprises a processing portion for processing said silver halide photographic light-sensitive material and a solid processing agent receiving portion which communicates with said processing portion and to which said solid processing agent is supplied, a means of circulating said processing solution between said processing portion and said solid processing agent receiving portion is present, a means of filtering the insoluble matter of said solid processing agent to prevent its deposition on said silver halide photographic light-sensitive material is present, which filtering means is immersed in the processing solution in said processing tank, said processing tanks include a developing tank for containing a developer and a bleach-fixing tank for containing a bleach-fixer and at least said stocking means, said supplying means and said controlling means are provided for each of said processing tanks, said processing tanks include a developing tank for containing a developer, a bleaching tank for containing a bleacher and a fixing tank for containing a fixer and at least said stocking means, said supplying means and said controlling means are provided for each of said processing tanks.

The objects of the present invention can also be accomplished by an automatic developing machine for silver halide photographic light-sensitive materials having a processing tank for containing a processing solution for processing an exposed silver halide photographic light-sensitive material, a means of stocking a solid processing agent, a means of supplying the solid processing agent to at least one of said processing tanks, a means of detecting information on the amount of processing of said silver halide photographic light-sensitive material, a means of controlling said supplying means according to the information on the amount of processing of said silver halide photographic light-sensitive material detected by said detecting means, a means of supplying a water replenisher to said processing tank, and a means of controlling said water replenisher supplying means according to the information detected by said detecting means.

By supplying a solid processing agent to the processing tank according to information on the amount of processing of silver halide photographic light-sensitive material, the present invention makes it possible to obviate the necessity of dissolving operation, to realize a compact automatic developing machine without replenisher tanks, to dramatically improve chemical stability and to significantly reduce or totally obviate the use of plastic containers.

In other words, the necessity of the use of replenisher tanks and bellows pumps for supplying the replenisher to the processing solution is obviated because a solid processing agent is supplied to the processing tank, which makes feasible a compact automatic developing machine with significantly decreased production cost. In addition, unexpectedly, the various problems in replenishers, such as crystal separation and tar formation, are all solved by the use of a solid processing agent.

Other advantages are that solid processing agents permit reduction of the amount of replenisher in comparison with liquid processing agents, and that there is no fear of liquid scattered during operation adhering or contaminating the human body, clothing or peripheral equipment.

Also, in the present invention, the provision of a water replenishing means makes it possible to keep the processing solution concentration constant and ensures stable performance. In addition, when the solid processing agent is in a tablet form, the replenishing accuracy is by far higher than that obtained by the method wherein a given volume of replenisher is supplied by means of a bellows pump, which facilitates concentration control.

In the present invention, the solid processing agent includes not only tablets, granules and powders but also those prepared by wrapping or coating said tablets, granules or powders with soluble films such as alkali-soluble films or water-soluble films. Neither paste nor slurry is the solid processing agent for the present invention.

The powder for the present invention means an aggregate of microcrystals. The granule for the present invention means a particulate product having a grain size of 50 to 5000 μm prepared by powder granulation. The tablet for the present invention means a product prepared by compressing a powder into a given shape.

The present invention is hereinafter described in detail.

Of the above solid processing agents, tablets are preferably used, since they offer high replenishing accuracy and are easy to handle.

For solidifying a photographic processing agent, various methods can be optionally selected; for example, a photographic processing agent in a dense solution, in fine powder or particulate form and a water-soluble binder are kneaded and formed, or a water-soluble binder is sprayed over the surface of a pre-formed photographic processing agent to form a coating (see Japanese Patent Application Nos. 135887/1990, 203165/1990, 203166/1990, 203167/1990, 203168/1990 and 300409/1990).

The preferred method of tablet production is the method wherein a powdery solid processing agent is granulated and then tableted. This method is advantageous in that photographic performance is stable as a result of improvement in solubility and storage stability in comparison with solid processing agents prepared solely by mixing and tableting the solid processing agent components.

For forming tablets, known granulating methods can be used, including tumbling granulation, extrusion granulation, compressive granulation, disintegration granulation, stirring granulation, fluidized bed granulation and spray drying granulation. In forming tablets, it is preferable to use a granulation product having an average grain size of 100 to 800 μm, more preferably 200 to 750 μm. Average grain sizes of under 100 μm or over 800 μm are undesirable because the component distribution becomes uneven, i.e., the so-called segregation occurs, when grains of the above granulation product are mixed and compressed. In addition, the grain size distribution is preferably such that the size of not less than 60% of the grains of the granulation product fall in the range of ±100 to 150 μm of the average grain size. In compressing the granulation product obtained, a known compressing machine, such as a hydraulic press, a single tableting machine, a rotary tableting machine or a briquetting machine, can be used. Although the solid processing agent obtained by compression can take any shape, cylindrical agents, i.e., the so-called tablets, are preferred from the viewpoint of productivity and handling quality.

More preferably, each component, such as the alkaline agent, reducing agent, bleaching agent or preservative, is separately granulated, whereby the above effect is enhanced.

Tablet processing agents can be produced by ordinary methods such as those described in Japanese Patent O.P.I. Publication Nos. 61837/1976, 155038/1979 and 88025/1977 and British Patent No. 1213808. Granular processing agents can be produced by ordinary methods such as those described in Japanese Patent O.P.I. Publication Nos. 109042/1990, 109043/1990, 39735/1991 and 39739/1991. Powder processing agents can be produced by ordinary methods such as those described in Japanese Patent O.P.I. Publication No. 133332/1979, British Patent Nos. 725892 and 729862 and German Patent No. 3733861.

From the viewpoint of solubility and the desired effect of the present invention, the apparent density of the solid photographic processing agent described above is preferably 1.0 to 2.5 g/cm$^3$; an apparent density exceeding 1.0 g/cm$^3$ is preferred from the viewpoint of the strength of the solid, and that under 2.5 g/cm$^3$ is preferred from the viewpoint of the solubility of the solid. When the solid processing agent is in a granular or powder form, its apparent density is preferably 0.40 to 0.95 g/cm$^3$.

Although the solid photographic processing agent for the present invention may be a color developing agent, a black-and-white developing agent, a bleaching agent, a fixing agent, a bleach-fixing agent, a stabilizing agent or another processing agent, the effect of the invention, especially the effect of stabilizing photographic performance, is enhanced when it is a color developing agent.

For the embodiment of the present invention, it is most preferable that all processing agents be solid; it is preferable to solidify at least the color developing agent. Since the color developing agent components include a large number of components which react mutually and also harmful components, the effect of the present invention is most enhanced when the color developing agent is solid. More preferably, the bleach-fixing agent or the bleaching agent and the fixing agent as well as the color developing agent are solidified.

Although it falls within the scope of the present invention to solidify only a part of processing agents, it is preferable that all the components essential for processing the light-sensitive material be contained in the solid processing agents.

All the components essential for processing the light-sensitive material are contained in the solid processing agents essential for processing the light-sensitive material means that all the processing agents supplied to respective processing tanks according to information on the amount of processing are added as solid processing agents. When a water replenisher is needed, all others are added as solid processing agents. In this case, at most the water replenisher alone is supplied to the processing tanks as a liquid. In other words, even when 2 or more processing tanks need replenishment, only a single tank for storing the replenishing liquid is sufficient as a result of sharing the water replenisher, which allows size reduction of the automatic developing machine.

In solidifying the color developing agent, a preferred mode of embodiment of the solid processing agent for the present invention is such that all of the alkaline agent, the coloring agent and the reducing agent are solidified and in the case of tablets, they are supplied in 3 or less agents, ideally 1 agent, whereby operability improves and mis-use by the user becomes less frequent, in comparison with the case where at least one of the alkaline agent, the coloring agent and the reducing agent is solidified while the others are used in a liquid form.

The water-soluble films or binders which are preferably used to bind or coat the processing agent are those based on polyvinyl alcohol, methyl cellulose, polyethylene oxide, starch, polyvinylpyrrolidone, hydroxypropyl cellulose, pullulan, dextran, gum arabic, polyvinyl acetate, hydroxyethyl cellulose, carboxyethyl cellulose, carboxymethylhydroxyethyl cellulose sodium salt, poly(alkyl) oxazoline or polyethylene glycol, with preference given to those based on polyvinyl alcohol or pullulan from the viewpoint of the coating or binding effect.

Preferred polyvinyl alcohol, a very good film-forming material, exhibits good strength and flexibility under almost all conditions. Commercially available polyvinyl alcohol compositions for inject-molded films vary widely as to molecular weight and the degree of hydrolysis; the molecular weight is preferably about 10000 to about 100000. Here, the degree of hydrolysis is defined as the ratio of acetic acid groups replaced by hydroxyl groups in the polyvinyl alcohol. For film application, the degree of hydrolysis is normally in the range of about 70 to 100%. As stated above, the term polyvinyl alcohol usually includes polyvinyl acetate compounds.

These water-soluble films are produced by ordinary methods such as those described in Japanese Patent O.P.I. Publication Nos. 124945/1990, 97348/1986, 158245/1985, 86638/1990, 117867/1982, 75650/1990, 226018/1984, 218741/1988 and 13565/1979.

Water-soluble films which are commercially available under trade names of Solupuron (produced by Aicello Kagaku), Hicellon (produced by Nichigo Film) and pullulan (produced by Hayashibara Co., Ltd.) can be used. Also, the 7-000 series polyvinyl alcohol films available from the MONO-SOL division of Chris Craft Industries Inc., which dissolve in water at temperatures of about 34 to 200 degrees Fahrenheit, which are harmless and which exhibit high chemical resistance, are particularly preferably used.

The film thickness of the water-soluble film is preferably 10 to 120 $\mu$, more preferably 15 to 80 $\mu$, and still more preferably 20 to 60 $\mu$. This is because film thicknesses of less than 10 $\mu$ result in poor storage stability of the solid processing agent and because film thicknesses exceeding 120 $\mu$ result in consumption of much time to dissolve the water-soluble film and pose a problem of crystal deposition on the inside wall of the automatic developing machine.

The water-soluble film is preferably thermoplastic. This is because thermoplasticity facilitates heat seal work and ultrasonic welding work and enhances the coating effect.

The tensile strength of the water-soluble film is preferably $0.5\times10^6$ to $50\times10^6$ kg/m$^2$, more preferably $1\times10^6$ to $25\times10^6$ kg/m$^2$, and still more preferably $1.5\times10^6$ to $10\times10^6$ kg/m$^2$. Tensile strength is determined by the method described in JIS Z-1521.

The photographic processing agent wrapped, bound or coated with a water-soluble film or a binder is preferably wrapped in a moisture-resistant wrapping material to prevent damage due to high humidities, atmospheric moisture such as rain and fog, and accidental contact with scattered water or wet hands during storage, transportation and handling. Said moisture-resistant wrapping material is preferably 10 to 150 $\mu$ thick. Preferably, said moisture resistance wrapping material is at least one selected from the group comprising polyolefin films such as those of polyethylene terephthalate, polyethylene and polypropylene, craft paper enhanced for moisture resistant by polyethylene, wax paper, moisture-resistant cellophane, glassine, polyester, polystyrene, polyvinyl chloride, polyvinylidene chloride, polyamide, polycarbonate, acrylonitrile and foils of metals such as aluminum, and metallized polymer films, and may be a composite thereof.

In the present invention, it is also preferable to use a degradable plastic, specifically a biodegradable or photodegradable plastic, as moisture-resistant wrapping material.

Said biodegradable plastics include 1) naturally occurring high molecular compounds, 2) microbial polymers, 3) highly biodegradable synthetic polymers and 4) blends of naturally occurring biodegradable high molecular substances in plastics. Photodegradable plastics include 5) those having in the main chain thereof a group whose bond is broken upon UV excitation. In addition to the above-mentioned high molecular substances, those which are both photodegradable and biodegradable can also be used preferably.

Typical examples of such substances are as follows. Examples of biodegradable plastics include:

1) naturally occurring high molecular substances such as polysaccharides, cellulose, polylacetic acid, chitin, chitosan, polyamino acid and modified configurations thereof;
2) microbial polymers such as Biopol, which is based on PHB-PHV (copolymer of 3-hydroxybutyrate and 3-hydroxyvalerate), and microbial cellulose;
3) highly biodegradable synthetic polymers such as polyvinyl alcohol, polycaprolactone and copolymers and mixtures thereof; and
4) blends of naturally occurring biodegradable high molecular substances in plastics such as those prepared by adding starch or cellulose to plastics to provide shape disintegrability.

Examples of photodegradable plastics include those having a carbonyl group introduced therein for photodisintegrability, which may be supplemented with UV absorbent for promoted disintegration.

Ordinary biodegradable plastics such as those described in "Kagaku to Kogyo", Vol. 64, No. 10, pp. 478–484 (1990) and "Kino Zairyo", 1990 July issue, pp. 23–34 can be used. Also usable biodegradable plastics are commercial products such as Biopol, produced by ICI, Eco, produced by Union Carbide, Ecolite, produced by Eco Plastic, Ecostar, produced by St. Lawrence Starch, and Knuckle P, produced by Nippon Unicar.

The moisture-resistant wrapping material described above is preferably not more than 10 g·mm/m$^2$ 24 hr, more preferably not more than 5 g·mm/m$^2$ 24 hr in water permeation coefficient.

As for means of supplying the solid processing agent to the processing tank in the present invention, when, for example, the solid processing agent is in a tablet form, known methods are available, including those described in Japanese Utility Model Publication Nos. 137783/1988, 97522/1988 and 85732/1989; any method is acceptable, as long as it is capable of supplying the tablets to the processing tank. When the solid processing agent is in a granular or powder form, known methods can be used, including the dynamic fall methods described in Japanese Utility Model Publication Nos. 81964/1987 and 84151/1988 and Japanese Patent O.P.I. Publication No. 292375/1989 and the screw methods described in Japanese Utility Model Publication Nos. 105159/1988 and 195345/1988, which are not to be construed as limitative.

The above solid processing agent supplying means has a controlling means for adding a given amount of solid processing agent according to information on the amount of processing of light-sensitive material, which is a key element of the present invention. Accordingly, this controlling means is essential for the automatic developing machine of the invention to keep the component concentration in each processing tank constant to ensure stable photographic performance. The information of the amount of processing of silver halide photographic light-sensitive material is a value in proportion to the amount of silver halide light-sensitive material which is to be processed, which was processed or which is being processed by the processing solution, indicating the reduction in the processing agent in the processing solution directly or indirectly. Detection timing may be before or after the light-sensitive material is transported to the processing solution or during its immersion in the processing solution. This information may also be of the amount of light-sensitive material printed by a printer, or the concentration of the processing solution contained in the processing tank or the change thereof.

The present invention offers a compact automatic developing machine free of replenisher tanks whose use was obviated by adding the solid processing agent to the processing tank. When a circulating means is provided, the solubility of solid processing agent becomes very good.

A p-phenylenediamine compound having a water-soluble group is preferably used as a color developing agent in the color developer for the present invention, since it enhances the desired effect of the invention and causes little fogging.

The p-phenylenediamine compounds having a water-soluble group are advantageous over the p-phenylenediamine compounds having no water-soluble group, such as N,N-diethyl-p-phenylenediamine, in that they do not contaminate the light-sensitive material and are not irritative to skin upon skin contact. In addition, their use in combination with the color developer for the present invention allows more efficient accomplishment of the desired object of the invention.

The p-phenylenediamine compound for the present invention has at least one water-soluble group as described above on the amino group or benzene nucleus thereof. Preferred water-soluble groups include:

$-(CH_2)_n-CH_2OH$, $-(CH_2)_m-NHSO_2-(CH_2)_n-CH_3$, $-(CH_2)_m-O-(CH_2)_n-CH_3$, $-(CH_2CH_2O)_nC_mH_{2m+1}$ (m and n independently represent an integer of not less than 0), a —COOH group and a $-SO_3H$ group.

Examples of color developing agents preferably used for the present invention are C-1 through C-16 described on pages 26 through 31 of Japanese Patent Application No. 203169/1990.

The color developing agent is used normally in the form of a salt such as hydrochloride, sulfate or p-toluenesulfonate.

The color developing agents described above may be used singly or in combination, and may be used in combination with black-and-white developing agents such as phenidone, 4-hydroxymethyl-4-methyl-l-phenyl-3-pyrrazolidone and Metol as desired.

It is a preferred mode of embodiment of the present invention to add a compound represented by the following formula A or B to the color developer relating to the present invention, whereby the desired effect of the invention is enhanced.

Specifically, the use of such a compound not only offers improved tablet storage stability in comparison with other compounds but also offers a tablet strength keeping effect. It is also advantageous in that stable photographic performance is obtained and fogging in the unexposed portion is suppressed.

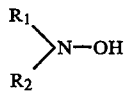

Formula A

With respect to formula A, $R_1$ and $R_2$ independently represent an alkyl group, an aryl group,

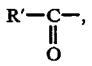

or a hydrogen atom, provided that they do not represent a hydrogen atom concurrently. The alkyl groups represented by $R_1$ and $R_2$ may be identical or different, each of which preferably has 1 to 3 carbon atoms. These alkyl groups may have a carboxylate group, a phosphate group, a sulfonate group or a hydroxyl group.

R' represents an alkoxy group, an alkyl group or an aryl group. The alkyl groups and aryl groups for $R_1$, $R_2$ and R' include those having a substituent. $R_1$ and $R_2$ may bind together to form a ring, such as a heterocyclic ring like piperidine, pyridine, triazine or morpholine.

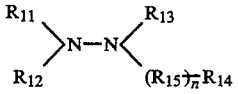

Formula B wherein $R_{11}$, $R_{12}$ and $R_{13}$ independently represent a hydrogen atom, a substituted or unsubstituted alkyl group, aryl group or heterocyclic group; $R_{14}$ represents a hydroxyl group, a hydroxyamino group, a substituted or unsubstituted alkyl group, aryl group, heterocyclic group, alkoxy group, aryloxy group, carbamoyl group or amino group. The heterocyclic group is a 5- or 6-membered ring comprising C, H, O, N, S and halogen atoms, whether saturated or unsaturated. $R_{15}$ represents a divalent group selected from the group comprising —CO—, —$SO_2$— and

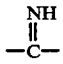

n represents 0 or 1. Provided that n is 0, $R_{14}$ represents a group selected from an alkyl group, an aryl group and a heterocyclic group; $R_{13}$ and $R_{14}$ may cooperate to form a heterocyclic group.

Examples of the hydroxylamine compound represented by formula A are given in U.S. Pat. Nos. 3287125, 33293034 and 3287124 and other publications. Particularly preferable compounds are compound Nos. A-1 through A-39 described on pages 36 through 38 of Japanese Patent Application No. 203169/1990, compound Nos. 1 through 53 described on pages 3 through 6 of Japanese Patent O.P.I. Publication No. 33845/1991 and compound Nos. 1 through 52 described on pages 5 through 7 of Japanese Patent O.P.I. Publication No. 63646/1991.

Examples of the compound represented by formula B are compound Nos. B-1 through B-33 described on pages 40 through 43 of Japanese Patent Application No. 203169/1990 and compound Nos. 1 through 56 described on pages 4 through 6 of Japanese Patent O.P.I. Publication No. 33846/1991.

These compounds represented by formula A or B are used normally in the forms of free amine, hydrochloride, sulfate, p-toluenesulfonate, oxalate, phosphate, acetate and others.

The color developer and black-and-white developer used for the present invention may incorporate a trace amount of sulfite as a preservative. Examples of such sulfites include sodium sulfite, potassium sulfite, sodium bisulfite and potassium bisulfite.

The color developer and black-and-white developer used for the present invention must contain a buffer. Examples of buffers include sodium carbonate, potassium carbonate, sodium bicarbonate, potassium bicarbonate, trisodium phosphate, tripotassium phosphate, dipotassium phosphate, sodium borate, potassium borate, sodium tetraborate (boric acid), potassium tetraborate, sodium o-hydroxybenzoate (sodium salicylate), potassium o-hydroxybenzoate, sodium 5-sulfo-2-hydroxybenzoate (sodium 5-sulfosalicylate) and potassium 5-sulfo-2-hydroxybenzoate (potassium 5-sulfosalicylate).

Examples of developing accelerators which can be added as necessary include the thioether compounds disclosed in Japanese Patent Examined Publication Nos. 16088/1962, 5987/1962, 7826/1963, 12380/1969 and 9019/1970 and U.S. Pat. No. 3813247, the p-phenylenediamine compounds disclosed in Japanese Patent O.P.I. Publication Nos. 49829/1977 and 15554/1975, the quaternary ammonium salts disclosed in Japanese Patent O.P.I. Publication Nos. 137726/1975, 156826/1981 and 43429/1977 and Japanese Patent Examined Publication No. 30074/1969, the p-aminophenols disclosed in U.S. Pat. Nos. 2610122 and 4119462, the amine compounds disclosed in U.S. Pat. Nos. 2494903, 3128182, 4230796, 3253919, 2482546, 2596926 and 3582346 and Japanese Patent Examined Publication No. 11431/1966, the polyalkylene oxides disclosed in Japanese Patent Examined Publication Nos. 16088/1962, 25201/1967, 11431/1966 and 23883/1966 and U.S. Pat. Nos. 3128183 and 3532501, and 1-phenyl-3-pyrrazolidones, hydrozines, meso-ionic compounds, ionic compounds and imidazoles.

Preferably, the color developer contains substantially no benzyl alcohol, specifically not more than 2.0 ml per liter of color developer, more preferably absolutely no benzyl alcohol. When the color developer contains substantially no benzyl alcohol, better results are obtained with less fluctuation in photographic properties in continuous processing, particularly less increase in the degree of staining.

For the prevention of fogging and other purposes, chlorine ions and bromine ions must be present in the color developer in the processing tank. In the present invention, it is preferable that chlorine ions be contained at $1.0\times10^{-2}$ to $1.5\times10^{-1}$ mol/l, more preferably $4\times10^{-2}$ to $1\times10^{-1}$ mol/l. Chlorine ion concentrations exceeding $1.5\times10^{-1}$ mol/l are undesirable for rapidly obtaining a high maximum density because development is retarded. Chlorine ion concentrations of less than $1.0\times10^{-2}$ mol/l are also undesirable because staining occurs and fluctuations in photographic properties (especially minimum density) in continuous processing widen. It is therefore necessary to adjust the solid processing agent so that the color developer in the processing tank falls within the above concentration range.

In the present invention, the color developer in the processing tank preferably contains bromine ions at a concentration of $3.0\times10^{-3}$ to $1.0\times10^{-3}$ tool/l, more preferably $5.0\times10^{-3}$ to $5\times10^{-4}$ tool/l, and still more preferably $1\times10^{-4}$ to $3\times10^{-4}$ mol/l. Bromine ion concentrations exceeding $1\times10^{-3}$ mol/l and those lower than $3.0\times10^{-3}$ mol/l are undesirable because development is retarded and the maximum density and sensitivity are lowered in the former case and because staining occurs and fluctuations in photographic properties (especially minimum density) occur during continuous processing in the latter case. The bromine ion concentration in the solid processing agent, like the chlorine ion concentration, must be adjusted to fall within the above range.

Provided that chlorine ions are added directly to the color developer, examples of chlorine ion sources include sodium chloride, potassium chloride, ammonium chloride, nickel chloride, magnesium chloride, manganese chloride, calcium chloride and cadmium chloride, with preference given to sodium chloride and potassium chloride.

Chlorine ions may also be supplied in the form of a counterpart salt of the color developer or the brightening agent added thereto. Examples of bromine ion sources include sodium bromide, potassium bromide, ammonium bromide, lithium bromide, calcium bromide, magnesium bromide, manganese bromide, nickel bromide, cadmium bromide, cerium bromide and thallium bromide, with preference given to potassium bromide and sodium bromide.

In addition to chlorine ions and bromine ions, the color developer and black-and-white developer used for the present invention may incorporate antifogging agents which are optionally selected as necessary. Antifogging agents which can be used include alkali metal halides such as potassium iodide and organic antifogging agents. Typical examples of organic antifogging agents include nitrogen-containing heterocyclic compounds such as benzotriazole, 6-nitrobenzimidazole, 5-nitroisoindazole, 5-methylbenzotriazole, 5-nitrobenzotriazole, 5-chlorobenzotriazole, 2--thiazolylbenzimidazole, 2-thiazolylmethylbenzimidazole, indazole, hydroxyazaindolidine and adenine.

From the viewpoint of the desired effect of the present invention, it is preferable to add a triazinylstylbene brightening agent to the color developer and black-and-white developer used for the present invention. Said brightening agent is preferably represented by the following formula E.

Formula E

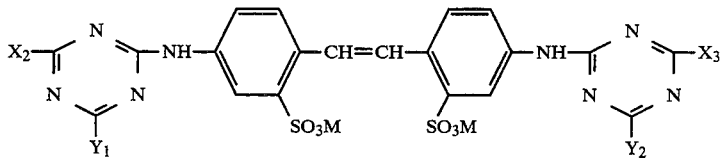

wherein $X_2$, $X_3$, $Y_1$ and $Y_2$ independently represent a hydroxyl group, a chlorine atom, a bromine atom or another halogen atom, an alkyl group, an aryl group,

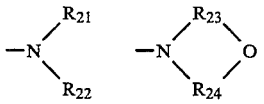

or —$OR_{25}$; wherein $R_{21}$ and $R_{22}$ independently represent a hydrogen atom, an alkyl group (may be substituted) or an aryl group (may be substituted); $R_{23}$ and $R_{24}$ each represent an alkylene group (may be substituted); $R_{25}$ represents an alkyl group (may be substituted) or an aryl group (may be substituted); M represents a cation.

Details of the groups in formula E and substituents therefor are the same as those described from the 8th line from the bottom of page 63 through the 3rd line from the bottom of page 64, of Japanese Patent Application No. 240400/1990.

Examples of the compound represented by formula E are given below.

| | M | $X_2$ | $Y_1$ | $X_3$ | $Y_2$ |
|---|---|---|---|---|---|
| E-1 | Na | 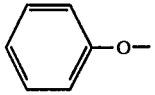 | $-NHC_2H_4OH$ | $-NHC_2H_4OH$ | 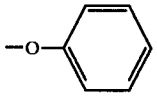 |
| E-2 | Na | $HOC_2H_4NH-$ | $-NHC_2H_4OH$ | $-NHC_2H_4OH$ | $-NHC_2H_4OH$ |
| E-3 | Na | 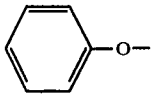 | $-N(C_2H_4OH)_2$ | $-N(C_2H_4OH)_2$ | 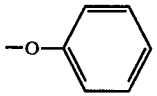 |
| E-4 | Na | $(HOC_2H_4)_2N-$ | $-OCH_3$ | $-OCH_3$ | $-NHC_2H_4SO_3Na$ |
| E-5 | Na | $HOCH_2CH_2NH-$ | $-N(C_2H_4OH)_2$ | $-N(C_2H_4OH)_2$ | $-NHCH_2CHOH$<br>\|<br>$CH_2OH$ |
| E-6 | Na | $(HOC_2H_4)_2N-$ | $-N(C_2H_4OH)_2$ | $-N(C_2H_4OH)_2$ | $-N(C_2H_4OH)_2$ |
| E-7 | Na | 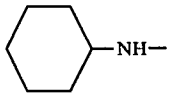 | $-NHC_2H_4OH$ | $-NHC_2H_4OH$ | 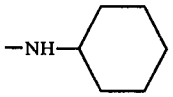 |
| E-8 | Na | 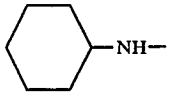 | $-N(C_2H_4OH)_2$ | $-N(C_2H_4OH)_2$ | 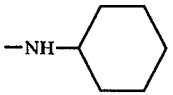 |
| E-9 | Na | $HO-$ | 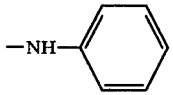 | 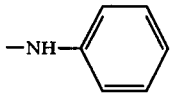 | $-OH$ |
| E-10 | Na | $H_2N-$ | 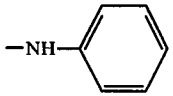 | 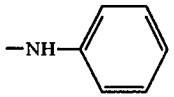 | $-NH_2$ |
| E-11 | Na | $CH_3O-$ | 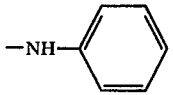 | 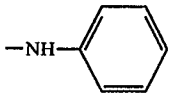 | $-OCH_3$ |

-continued
| | M | $X_2$ | $Y_1$ | $X_3$ | $Y_2$ |
|---|---|---|---|---|---|
| E-12 | Na | $HOC_2H_4NH-$ | 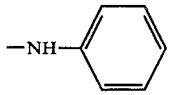 | 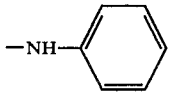 | $-NHC_2H_4OH$ |
| E-13 | Na | $(HOC_2H_4)_2N-$ | 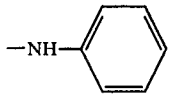 | 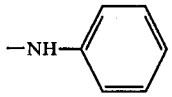 | $-N(C_2H_4OH)_2$ |
| E-14 | Na | $HOC_2H_4NH-$ | 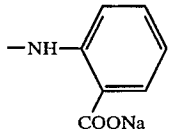 | 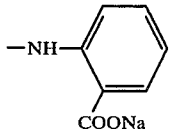 | $-NHC_2H_4OH$ |
| E-15 | Na | 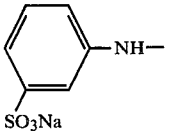 | $-N(C_2H_4OH)_2$ | $-N(C_2H_4OH)_2$ | 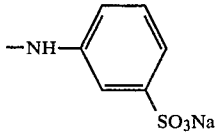 |
| E-16 | Na | 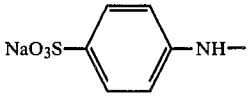 | $-N(C_2H_4OH)_2$ | $-N(C_2H_4OH)_2$ | 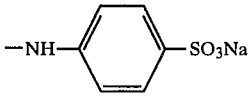 |
| E-17 | Na | 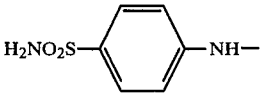 | $-N(C_2H_4OH)_2$ | $-N(C_2H_4OH)_2$ | 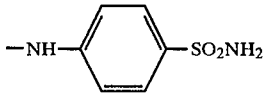 |
| E-18 | Na | 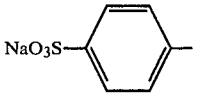 | $-N(C_2H_4OH)_2$ | $-N(C_2H_4OH)_2$ | 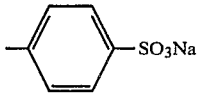 |
| E-19 | Na | $HOCH_2CH(CH_3)CH_2HN-$ | $-OCH_3$ | $-OCH_3$ | $-NHCH_2CH(CH_3)CH_2OH$ |

-continued
| | M | $X_2$ | $Y_1$ | $X_3$ | $Y_2$ |
|---|---|---|---|---|---|
| E-20 | Na | $(HOC_2H_4)_2N-$ | 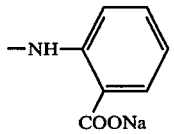 | 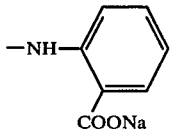 | $-N(C_2H_4OH)_2$ |
| E-21 | Na | $HOC_2H_4NH-$ | 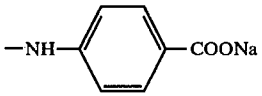 | 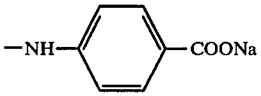 | $-NHC_2H_4OH$ |
| E-22 | Na | 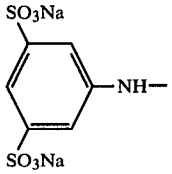 | $-NHC_2H_5$ | $-NHC_2H_5$ | 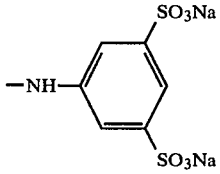 |
| E-23 | Na | 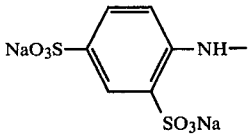 | $-NHCH_3$ | $-NHCH_3$ | 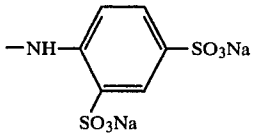 |
| E-24 | Na | 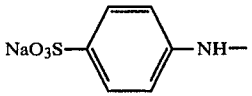 | 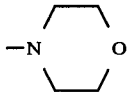 | 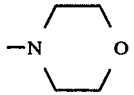 | 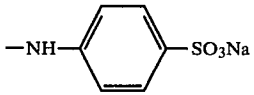 |
| E-25 | Na | $HOC_2H_4NH-$ | 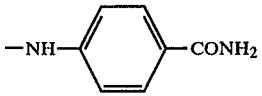 | 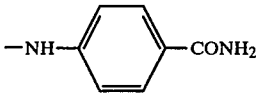 | $-NHC_2H_4OH$ |
| E-26 | Na | $HOC_2H_4NH-$ | 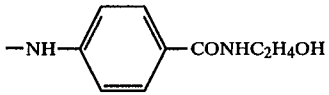 | 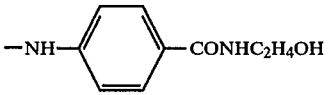 | $-NHC_2H_4OH$ |

-continued
| | M | $X_2$ | $Y_1$ | $X_3$ | $Y_2$ |
|---|---|---|---|---|---|
| E-27 | Na | $(HOC_2H_4)_2N-$ | 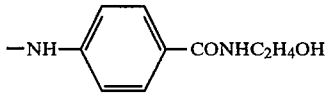 | 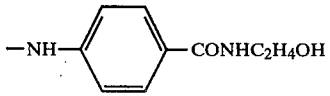 | $-N(C_2H_4OH)_2$ |
| E-28 | Na | $HOC_2H_4NH-$ | 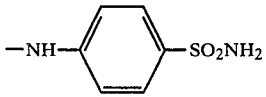 | 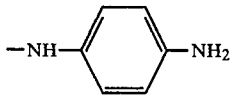 | $-NHC_2H_4OH$ |
| E-29 | Na | $HOC_2H_4NH-$ | 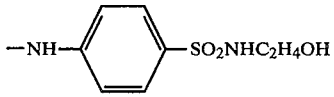 | 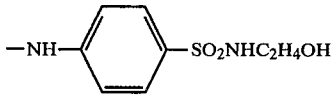 | $-NHC_2H_4OH$ |
| E-30 | Na | $(HOC_2H_4)_2N-$ | 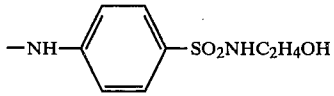 | 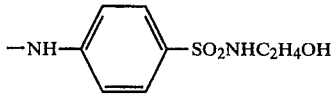 | $-N(C_2H_4OH)_2$ |
| E-31 | Na | 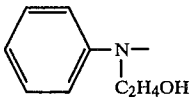 | 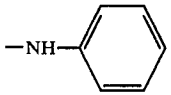 | 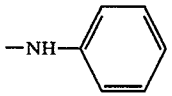 | 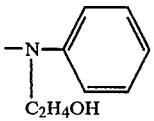 |
| E-33 | Na | 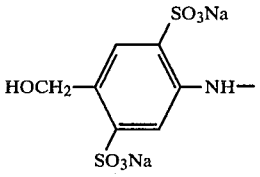 | 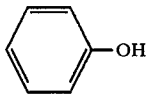 | 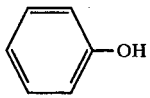 | 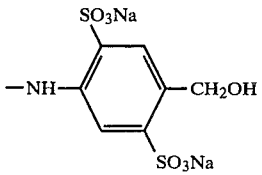 |
| E-33 | Na | 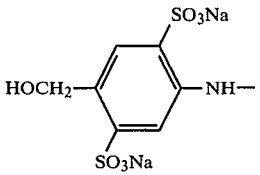 | $-NHC_2H_5$ | $-NHC_2H_5$ | 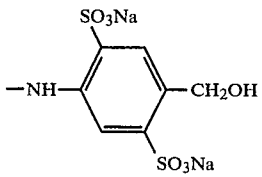 |
| E-34 | Na | $CH_3O-$ | $-NHCH_2CH(OH)CH_3$ | $-NHCH_2CH(OH)CH_3$ | $-OCH_3$ |

-continued
| | M | $X_2$ | $Y_1$ | $X_3$ | $Y_2$ |
|---|---|---|---|---|---|
| E-35 | Na | 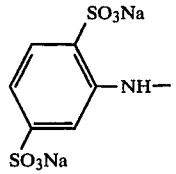 | 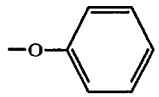 | 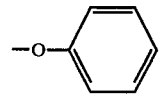 | 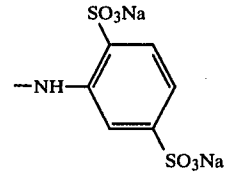 |
| E-36 | Na | 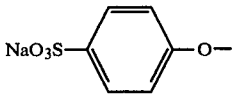 | $-N(C_2H_4OH)_2$ | $-N(C_2H_4OH)_2$ | 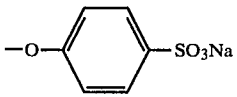 |
| E-37 | Na | 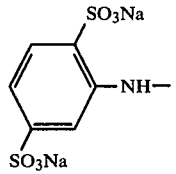 | $-N(C_2H_5)_2$ | $-N(C_2H_5)_2$ | 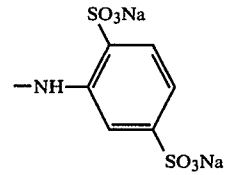 |
| E-38 | Na | 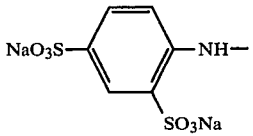 | $-NHCH_3$ | $-NHCH_3$ | 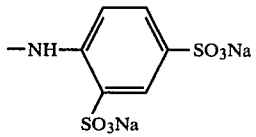 |
| E-39 | Na | $CH_3O-$ | $-NHCH(CH_2OH)CH_3$ | $-NHCH(CH_2OH)CH_3$ | $-OCH_3$ |
| E-40 | Na | $CH_3O-$ | $-N(C_2H_4OH)_2$ | $-N(C_2H_4OH)_2$ | $-OCH_3$ |
| E-41 | Na | $CH_3O-$ | $-NHC_2H_4SO_3Na$ | $-NHC_2H_4SO_3Na$ | $-OCH_3$ |
| E-42 | Na | $CH_3O-$ | $-NHC_2H_4OH$ | $-NHC_2H_4OH$ | $-OCH_3$ |
| E-43 | Na | $CH_3O-$ | 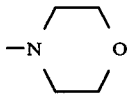 | 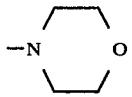 | $-OCH_3$ |
| E-44 | Na | $CH_3O-$ | $-NHC_2H_4SO_3K$ | $-NHC_2H_4SO_3K$ | |
| E-45 | Na | 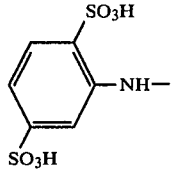 | $-N(C_2H_5)_2$ | $-N(C_2H_5)_2$ | 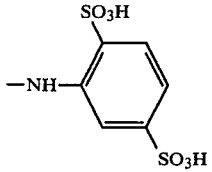 |

These compounds can be synthesized by known methods. Of the example compounds given above, E-4, E-24, E-34, E-35, E-36, E-37 and E-41 are preferably used. It is preferable to adjust the solid processing agent so that the amount of these compounds added falls within the range of 0.2 g to 10 g, more preferably of 0.4 g to 5 g per liter of color developer.

The color developer and black-and-white developer composition used for the present invention may also incorporate organic solvents such as methyl cellosolve, methanol, acetone, dimethylformamide, β-cyclodextrin and the compounds described in Japanese Patent Examined Publication Nos. 33378/1972 and 9509/1979 for increasing the solubility of the developing agent as necessary.

Auxiliary developing agents may be used in combination with the principal developing agent. Examples of such auxiliary developing agents include N-methyl-p-aminophenol hexasulfate (Metol), phenidone, N,N-diethyl-p-aminophenol hydrochloride and N,N,N',N'-tetramethyl-p-phenylenediamine hydrochloride.

It is also possible to use various additives such as antistaining agents, anti-sludge agents and lamination effect enhancers.

It is preferable from the viewpoint of efficient accomplishment of the desired effect of the present invention that the color developer and black-and-white developer composition incorporate one of the chelating agent represented by the following formula K and example compound Nos. K-1 through K-22, described from the 8th line from the bottom of page 63 through the 3rd line from the bottom of page 64, of Japanese Patent Application No. 240400/1990.

Formula K

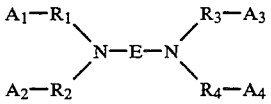

Of these chelating agents, K-2, K-9, K-12, K-13, K-17 and K-19 are preferably used, with more preference given to K-2 and K-9, since their addition to the color developer enhances the effect of the invention.

It is preferable to add these chelating agents in amounts of from 0.1 to 20 g, more preferably from 0.2 to 8 g per liter of color developer or black-and-white developer.

The color developer and black-and-white developer may also contain anionic, cationic, amphoteric and nonionic surfactants.

Various surfactants such as alkylsulfonic acids, arylsulfonic acids, aliphatic carboxylic acids and aromatic carboxylic acids may be added as necessary.

The bleaching agents which are preferably used in the bleacher or bleach-fixer relating to the present invention are ferric complex salts of the organic acid represented by the following formula C.

Formula IV

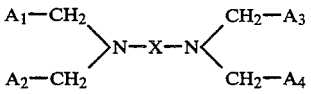

Formula C wherein $A_1$ through $A_4$, whether identical or not, independently represent —$CH_2OH$, —COOM or —$PO_3M_1M_2$; M, $M_1$ and $M_2$ independently represent a hydrogen atom, an atom of alkali metal or ammonium. X represents a substituted or unsubstituted alkylene group having 3 to 6 carbon atoms.

The compound represented by formula C is described in detail below. $A_1$ through $A_4$ in formula C are not described in detail here, since they have the same definitions as $A_1$ through $A_4$ described in line 15, page 12, through line 3, page 15, of Japanese Patent Application No. 260628/1989.

Examples of preferred compounds represented by the above formula C are given below.

The ferric complex salts of organic acid represented by formula C are preferably used for the present invention, since only a small amount is required for solidification because of their high bleaching capability, which permits the obtainment of lighter, smaller tablets, and since they offer good storage stability for tablets.

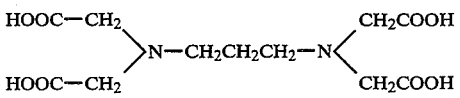

(C-1)

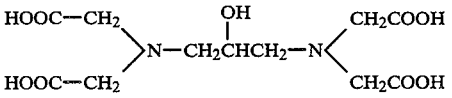

(C-2)

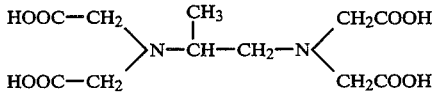

(C-3)

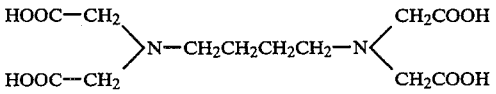

(C-4)

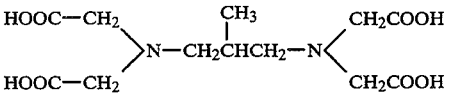

(C-5)

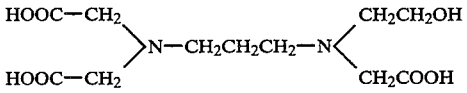

(C-6)

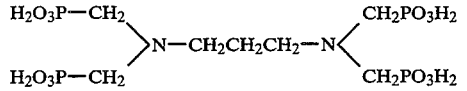

(C-7)

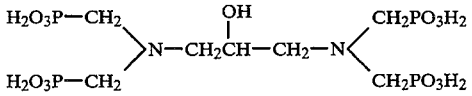

(C-8)

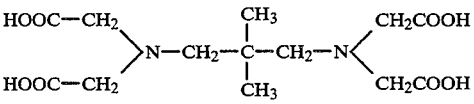

(C-9)

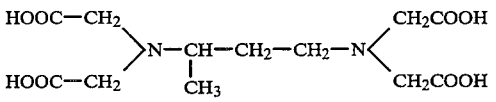

(C-10)

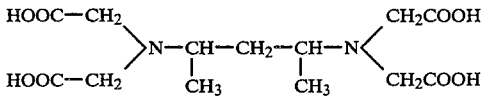

(C-11)

-continued

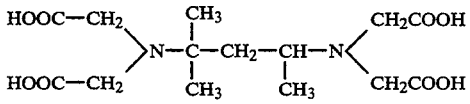

(C-12)

The ferric complex salts of these compounds C-1 through C-12 may be sodium salts, potassium salts or ammonium salts thereof, which can be selected optionally. From the viewpoint of the desired effect of the present invention and solubility, ammonium salts of these ferric complex salts are preferably used.

Of the compounds exemplified above, C-1, C-3, C-4, C-5 and C-9 are preferred, with more preference given to C-1.

In the present invention, ferric complex salts of the following compounds and others can be used as bleaching agents for the bleacher or bleach-fixer in addition to the iron complex salts of the compound represented by the above formula C.

A'-1: Ethylenediaminetetraacetic acid
A'-2: trans-1,2-cyclohexanediaminetetraacetic acid
A'-3: Dihydroxyethylglycinic acid
A'-4: Ethylenediaminetetrakismethylenephosphonic acid
A'-5: Nitrilotrismethylenephosphonic acid
A'-6: Diethylenetriaminepentakismethylenephosphonic acid
A'-7: Diethylenetriaminepentaacetic acid
A'-8: Ethylenediaminediorthohydroxyphenylacetic acid
A'-9: Hydroxyethylethylenediaminetriacetic acid
A'-10: Ethylenediaminedipropionic acid
A'-11: Ethylenediaminediacetic acid
A'-12: Hydroxyethyliminodiacetic acid
A'-13: Nitrilotriacetic acid
A'-14: Nitrilotripropionic acid
A'-15: Triethylenetetraminehexaacetic acid
A'-16: Ethylenediaminetetrapropionic acid
A'-17: β-alaninediacetic acid The amount of the above-mentioned ferric complex salt of organic acid added is preferably in the range of 0.01 to 2.0 mol, more preferably of 0.05 to 1.5 mol per liter of bleacher or bleach-fixer. It is therefore necessary to adjust the solid processing agent so that the organic acid ferric complex salt concentration of the bleacher or bleach-fixer in the processing tank falls within the above range.

The bleacher, bleach-fixer and fixer may incorporate at least one of the imidazole described in Japanese Patent O.P.I. Publication No. 295258/1989, derivatives thereof and the compounds represented by formulas I through IX given in the same publication, whereby rapid processing is facilitated.

In addition to the above-mentioned developing accelerators, the example compounds given on pages 51 through 115 of Japanese Patent O.P.I. Publication No. 123459/1987, the example compounds given on pages 22 through 25 of Japanese Patent O.P.I. Publication No. 17445/1988 and the compounds described in Japanese Patent O.P.I. Publication Nos. 95630/1978 and 28426/1978 can also be used.

In addition to the above-mentioned additives, the bleacher or bleach-fixer may incorporate halides such as ammonium bromide, potassium bromide and sodium bromide, various brightening agents, defoaming agents and surfactants.

The fixing agents which are preferably used in the fixer or bleach-fixer for the present invention are thiocyanates and thiosulfates. The thiocyanate content in the bleacher or bleach-fixer is preferably not less than 0.1 mol/l, more preferably not less than 0.5 mol/l, and still more preferably not less than 1.0 mol/l for processing a color negative film. The thiosulfate content is preferably not less than 0.2 mol/l, more preferably not less than 0.5 mol/l for processing a color negative film. Also, the object of the present invention can be more efficiently accomplished by using a thiocyanate and a thiosulfate in combination.

In addition to these fixing agents, the fixer or bleach-fixer for the present invention may contain a single or two or more pH regulators comprising various salts. It is also desirable to add a large amount of a re-halogenating agent such as an alkali halide or an ammonium halide, e.g., potassium bromide, sodium bromide, sodium chloride or ammonium bromide. Compounds which are known to be added to fixer or bleach-fixer, such as alkylamines and polyethylene oxides, may be added as appropriate.

It is preferable to add a compound represented by the following formula FA described on page 56 of Japanese Patent O.P.I. Publication No. 295258/1989 to the fixer or bleach-fixer, whereby not only the effect of the invention is enhanced but also an additional effect is obtained in that sludge formation in the processing solution capable of fixing is significantly suppressed during prolonged processing of a small amount of light-sensitive material.

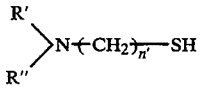

Formula FA

Compounds represented by formula FA can be synthesized by an ordinary method as described in U.S. Pat. Nos. 3335161 and 3260718. These compounds represented by formula FA may be used singly or in combination.

Good results are obtained when these compounds represented by formula FA are used in amounts of 0.1 to 200 g per liter of the fixer or bleach-fixer.

In the present invention, it is preferable to add a chelating agent having a ferric ion chelate stability constant of over 8 to the stabilizer. Here, the chelate stability constant is the constant which is well known in L.G. Sillen and A.E. Martell, "Stability Constants of Metal Ion Complexes", The Chemical Society, London (1964), S. Chaberek and A.E. Martell, "Organic Sequestering Agents", Wiley (1959), and other publications.

Examples of chelating agents having a ferric ion chelate stability constant of over 8 include those described in Japanese Patent Application Nos. 234776/1990 and 324507/1989.

The amount of the above chelating agent used is preferably 0.01 to 50 g, more preferably 0.05 to 20 g per liter of stabilizer, in which good results in content range are obtained.

Ammonium compounds are preferably added to the stabilizer, which are supplied as ammonium salts of various inorganic compounds. The amount of ammonium compound added is preferably in the range of 0.001 to 1.0 tool, more preferably of 0.002 to 2.0 tool per liter of stabilizer.

The stabilizer preferably contains a sulfite.

The stabilizer preferably contains a metal salt in combination with the chelating agent described above. Examples of such metal salts include salts of Ba, Ca, Ce, Co, In, La, Mn, Ni, Bi, Pb, Sn, Zn, Ti, Zr, Mg, Al and Sr, and it can be supplied as an inorganic salt such as halide, hydroxide, sulfate, carbonate, phosphate or acetate, or a water-soluble chelating agent. The amount of metal salt added is preferably in the range of $1\times10^{-4}$ to $1\times10^{-1}$ mol, more preferably of $4\times10^{-4}$ to $2\times10^{-2}$ mol per liter of stabilizer.

The stabilizer may contain an organic salt such as citrate, acetate, succinate, oxalate or benzoate, and a pH regulator such as malate, borate, hydrochloric acid or sulfate. In the present invention, one or more known fungicides can be used singly or in combination, as long as the use thereof does not adversely affect the effect of the invention.

Also, it is preferable to use deionized water for the stabilizer. It is another preferred mode of embodiment of the present invention to use a reverse osmotic membrane to reduce the replenishing rate, wherein a solution with high salt concentration is returned to the first tank of fixer, bleach-fixer or stabilizer, while a solution with low salt concentration is returned to the last tank of stabilizer.

Next, an example of automatic developing machine to which the present invention is applicable is described by means of drawings. FIG. 1 is a schematic diagram of a printer processor wherein automatic developing machine A and photographic printer B are unified.

In FIG. 1, in the lower left of photographic printer B is set magazine M housing a roll of printing paper which is an unexposed silver halide photographic light-sensitive material. The printing paper drawn from the magazine is cut into a sheet of printing paper of given size via roller R and cutter portion C. This sheet of printing paper is transported by transporting belt B to exposure portion E, where it is subjected to exposure for original image O. The thus-exposed sheet of printing paper is further transported by a number of pairs of feed roller R to automatic developing machine A. In automatic developing machine A, the sheet of printing paper is sequentially transported through color developing tank 1A, bleach-fixing tank 1B and stabilizing tanks 1C, 1D and 1E (comprising substantially three tanks) by a transporting roller (no reference symbol given), where it is subjected to color development, bleach-fixation and stabilization, respectively. The sheet of printing paper thus processed is dried at drying portion 35 and then discharged out of the automatic developing machine.

In the figure, the dashed line indicates the transportation path for silver halide photographic light-sensitive material. Also, although the light-sensitive material is introduced to automatic developing machine A in a cut form in this example, it may be introduced to the automatic developing machine in a band form. In such a case, processing efficiency can be improved by providing an accumulator for transient retention of the light-sensitive material between automatic developing machine A and photographic printer B. Also, the automatic developing machine relating to the present invention may be unified with photographic printer B or may stand alone. The silver halide photographic light-sensitive material processed by the automatic developing machine relating to the present invention is not limited to exposed printing paper; it may be an exposed negative film or the like. Although the following description of the present invention is concerned with an automatic developing machine which comprises substantially three tanks, namely a color developing tank, a bleach-fixing tank and a stabilizing tank, it is not to be construed as limitative; the invention is also applicable to automatic developing machines which comprise substantially four tanks, namely a color developing tank, a bleaching tank, a fixing tank and a stabilizing tank.

Figure 2:
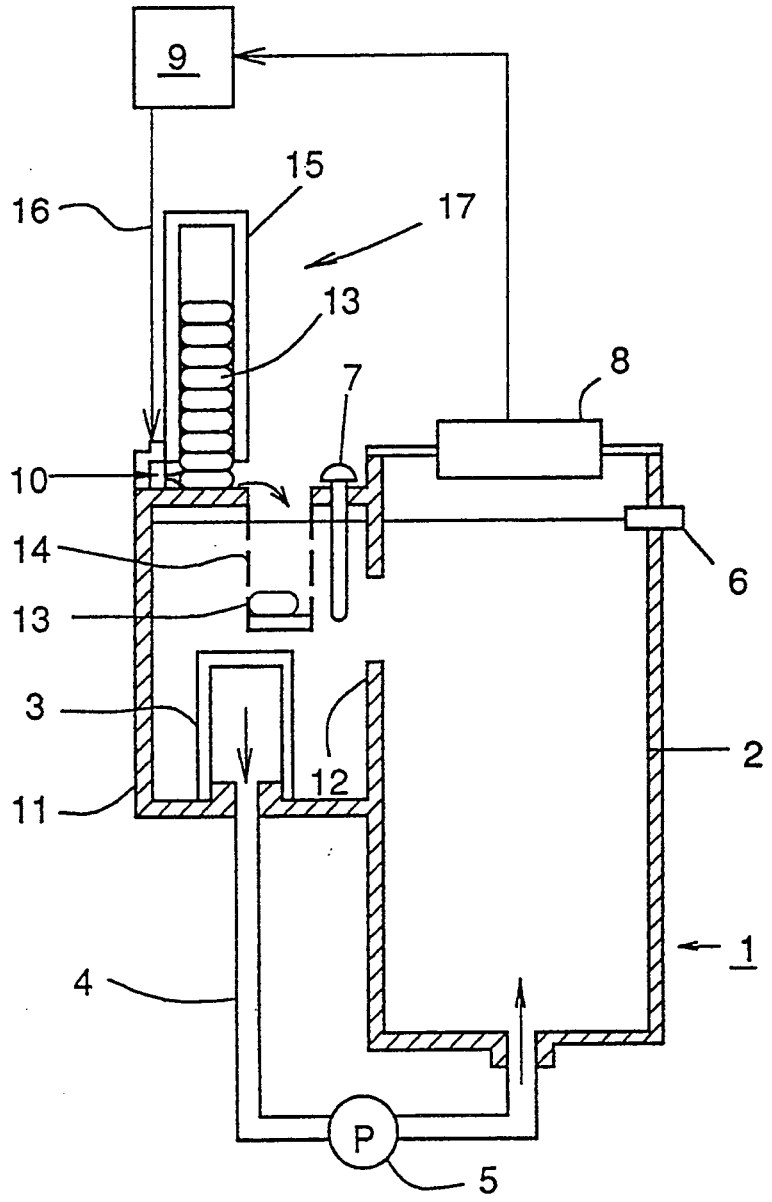
FIG. 2 is a schematic diagram of color developing tank 1A of automatic developing machine A of FIG. 1 as viewed on the I—I cross-section thereof.

FIG. 2 is a schematic diagram of color developing tank 1A of automatic developing machine A in FIG. 1 as viewed on the I—I cross-section thereof. Bleach-fixing tank 1B and stabilizing tanks 1C, 1D and 1E are of the same configuration as color developing tank 1A; processing tank 1 mentioned hereinafter means any of color developing tank 1A, bleach-fixing tank 1B and stabilizing tanks 1C, 1D and 1E. In the figure, light-sensitive material transporting means etc. are not illustrated for simple representation. Also, the present example is concerned with the use of tablet 13 as a solid processing agent.

Processing tank 1 has processing portion 2 for processing a light-sensitive material and solid processing agent receiving portion 11 which is unified outside the separating wall of said processing portion 2 and to which tablet 13 is supplied. Processing portion 2 and solid processing agent receiving portion 11 are mutually separated by separating wall 12 having a communicating window, which allows passage of the processing solution.

Cylindrical filter 3, provided under solid processing agent receiving portion 11 in an exchangeable state, functions to remove insoluble substances such as paper rubbish from the processing solution. The inside of filter 3 communicates to the aspiration side of circulatory pump 5 (means of circulation) via circulatory pipe 4 set through the lower wall of solid processing agent receiving portion 11.

The circulatory system is configured with circulatory pipe 4 forming a solution circulating path, circulatory pump 5, processing tank 1 and other components. The other end of circulatory pipe 4 communicating to the discharge side of circulatory pump 5 passes through the lower wall of processing portion 2 and communicates to said processing portion 2. By this configuration, upon activation of circulatory pump 5, the processing solution is aspirated via solid processing agent receiving portion 11 and discharged to the processing portion, where it is mixed with the processing solution in processing portion 2 and then returned to solid processing agent receiving portion 11; this circulation is repeated in cycles. The flow rate of this circulatory flow is preferably not less than 0.5 rotations (1 rotation=circulatory volume/tank capacity), more preferably 0.75 to 2.0 rotations per minute relative to the tank capacity. This is because too high circulatory flow rates can cause the solution surface to wave and hence cause the processing solution to leak out of processing tank 1. In addition, circulatory pump 5 must be of large size. Also, the direction of circulation of the processing solution is not limited to the direction shown in FIG. 2; it may be opposite.

Waste liquid discharge pipe 6, which is for overflowing the processing solution in processing portion 2, serves not only to keep the liquid level constant but also to prevent retention and concentration of the components carried over with the light-sensitive material from the processing solution in the processing portion and the components oozing out from the light-sensitive material.

Bar heater 7 is arranged in such manner that it passes through the upper wall of solid processing agent receiving portion 11 and is immersed in the processing solution in solid processing agent receiving portion 11. This heater 7 is for heating the processing solutions in solid processing agent receiving portion 11 and processing portion 1, i.e., it is a temperature controlling means for retaining the processing solutions in processing portion 2, solid processing agent receiving portion 11 and processing portion 1 in an appropriate temperature range (e.g., 25° to 55° C.).

Processing amount information detecting means 8, provided at the inlet of the automatic developing machine, is used to detect information on the amount of light-sensitive material processed. This processing amount information detecting means 8 comprises detection parts arranged on the left and right side and functions as an element for detecting the width of the light-sensitive material and for counting the detection time. Because the transportation rate of the light-sensitive material is pre-set mechanically, the area of light-sensitive material processed can be calculated from information on the width and the time. Any processing amount information detecting means can be used one, as long as it is capable of detecting the width and transportation time of light-sensitive material. Examples of such processing amount information detecting means include an infrared sensor, a microswitch and an ultrasonic sensor. In the case of the printer processor of FIG. 1, the processing amount information detecting means may be such that the area of light-sensitive material processed is indirectly detected, e.g., the amount of light-sensitive material printed, or the number of pre-set area of light-sensitive material units processed may be detected. Detection timing, which is before processing in the present example, may be after processing or during immersion in the processing solution (these can be achieved by properly changing the position of processing amount information detecting means 8 to another position allowing information detection after or during processing). The information detected is not limited to the area of light-sensitive material processed as in the above description; any information can serve the purpose, as long as it is a value in proportion to the amount of light-sensitive material which is to be processed, which was processed or which is being processed; it may be the concentration of the processing solution in the processing tank or the change therein. Processing amount information detecting means 8 need not always be provided for each of processing tanks 1A, 1B, 1C, 1D and 1E; it is preferable to provide one processing amount information detecting means 8 for each automatic developing machine.

Processing agent supplying means 17, arranged above filtering portion 14 described below, has cartridge 15 containing tablet 13 which is a solid processing agent, and pusher 10 for pushing out one or more pieces of tablet 13. This processing agent supplying means 17 is controlled by processing agent supply controlling means 9 described later and synchronizes with the supplying signal sent by processing agent supply controlling means 9 to push out waiting tablet 13 by means of pusher 10 to filtering portion 14 in solid processing agent receiving portion 11. In the present invention, solid processing agent 13 is supplied to filtering portion 14 in solid processing agent receiving portion 11, but it may be supplied to any portion, as long as the location is in processing tank 1. In other words, with respect to the position to which the solid processing agent is added, the present invention requires nothing more than the capability of dissolving the solid processing agent using the processing solution; it is necessary to add the components according to the information on the amount of light-sensitive material processed and keep the processing performance of the processing solution in processing tank 1 constant. More preferably, the solid processing agent is supplied to the circulatory path of the processing solution. Preferably, this processing agent supplying means 17 is arranged to avoid contact of the solid processing agent before being supplied to the processing tank with moisture in the processing tank of the automatic developing machine, atmospheric moisture and the spilled processing solution.

Filtering means 14, immersed in the processing solution in solid processing agent receiving portion 11, removes the substances which originate from tablet 13 and other types of solid processing agent and which can cause flaws in the finished image, poor processing in the portion to which they adhere, and other undesirable things, if they adhere to the light-sensitive material, such as insoluble substances from tablet 13 supplied by processing agent supplying means 17, e.g., insoluble contaminants in tablet 13, and lumps of tablet 13 resulting from its disintegration. This filtering means 14 is coated with resin. The filtering portion need not always be provided in solid processing agent receiving portion 11; it may be provided at any position, as long as tablet 13 supplied by processing agent supplying means 17 does not enter the light-sensitive material transporting path illustrated in FIG. 1 or the processing solution in processing portion 2.

Processing agent supply controlling means 9 controls processing agent supplying means 17; when the information on the amount of light-sensitive material processed (the area of light-sensitive material processed, in the present example) detected by processing amount information detecting means 8 reaches the specified level, it sends a processing agent supplying signal to processing agent supplying means 17. Processing agent supply controlling means 9 controls processing agent supplying means 17 so that the required amount of processing agent according to the information on the amount of light-sensitive material processed is supplied to solid processing agent receiving portion 11.

Next, the action of the present invention is described by means of FIG. 2. With respect to the exposed light-sensitive material, information on the amount of processing is detected by processing amount information detecting means 8 at the inlet of automatic developing machine A. Upon reach of the integrated area of light-sensitive material processed to the preset level, processing agent supply controlling means 9 passes a supplying signal to processing agent supplying means 17 according to the information on the amount of processing detected by processing amount information detecting means 8. Upon supplying signal reception, processing agent supplying means 17 pushes out and supplies tablet 13 by means of pusher 10 to filtering portion 14 in solid processing agent receiving portion 11. Tablet 13 thus supplied is dissolved in the processing solution in solid processing agent receiving portion 11, wherein its dissolution is facilitated by the processing solution being circulated by a means of circulation in the cycle of solid processing agent receiving portion 11 → circulatory pump 5 →]processing portion 2 → communicating window → solid processing agent receiving portion 11. The detected light-sensitive material is sequentially transported by a transporting roller through color developing tank 1A, bleach-fixing tank 1B and stabilizing tanks 1C, 1D and 1E (see automatic developing machine A in FIG. 1). Color developing tank 1A, bleach-fixing tank 1B and stabilizing tanks 1C, 1D and 1E may be equipped with processing agent supplying means 17A, 17B, 17C, 17D and 17E, respectively, for simultaneously supplying the processing agent thereto. Supplying timing may be different among these supplying means. The preset area based on which the processing agent supplying means are controlled by processing agent supply controlling means 9 may be the same among processing tanks 1A, 1B, 1C, 1D and 1E or different.

Another example of the present invention is described below. Bleach-fixing tank 1B and stabilizing tanks 1C, 1D and 1E are of the same configuration as color developing tank 1A; processing tank 1 mentioned hereinafter means any of color developing tank 1A, bleach-fixing tank 1B and stabilizing tanks 1C, 1D and 1E. Since the same numbers as those in FIG. 2 are used for corresponding components having the same function, they are not described here. Also, light-sensitive material transporting means etc. are not illustrated for simple representation.

As stated above, the present invention is excellently effective in that a compact automatic developing machine is realized because replenisher tanks are unnecessary, which are necessary for conventional automatic developing machines, and hence no space therefor is required, is that solution preparing operation is unnecessary because a solid processing agent is supplied to the processing tank so that there is no fear of solution scattering, adhesion and contamination of the human body, clothing and peripheral equipment during solution preparation and handling is easy, and in that processing solution replenishing accuracy improves so that stable processing performance is obtained without deterioration of the processing agent replenisher components.

Figure 3:
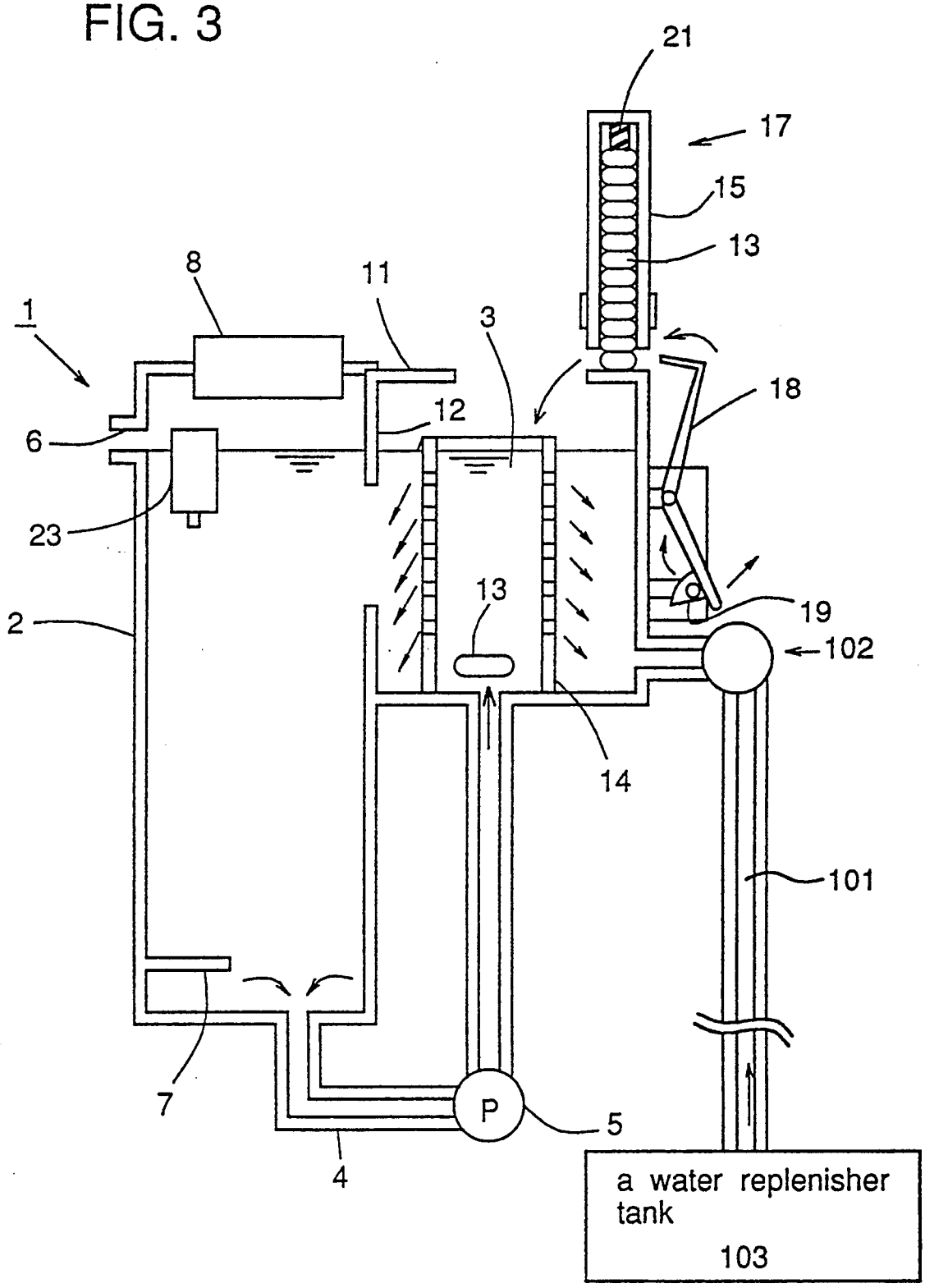
FIG. 3 is another schematic diagram of color developing tank 1A of automatic developing machine A of FIG. 1 as viewed on the I—I cross-section thereof.
Figure 4:
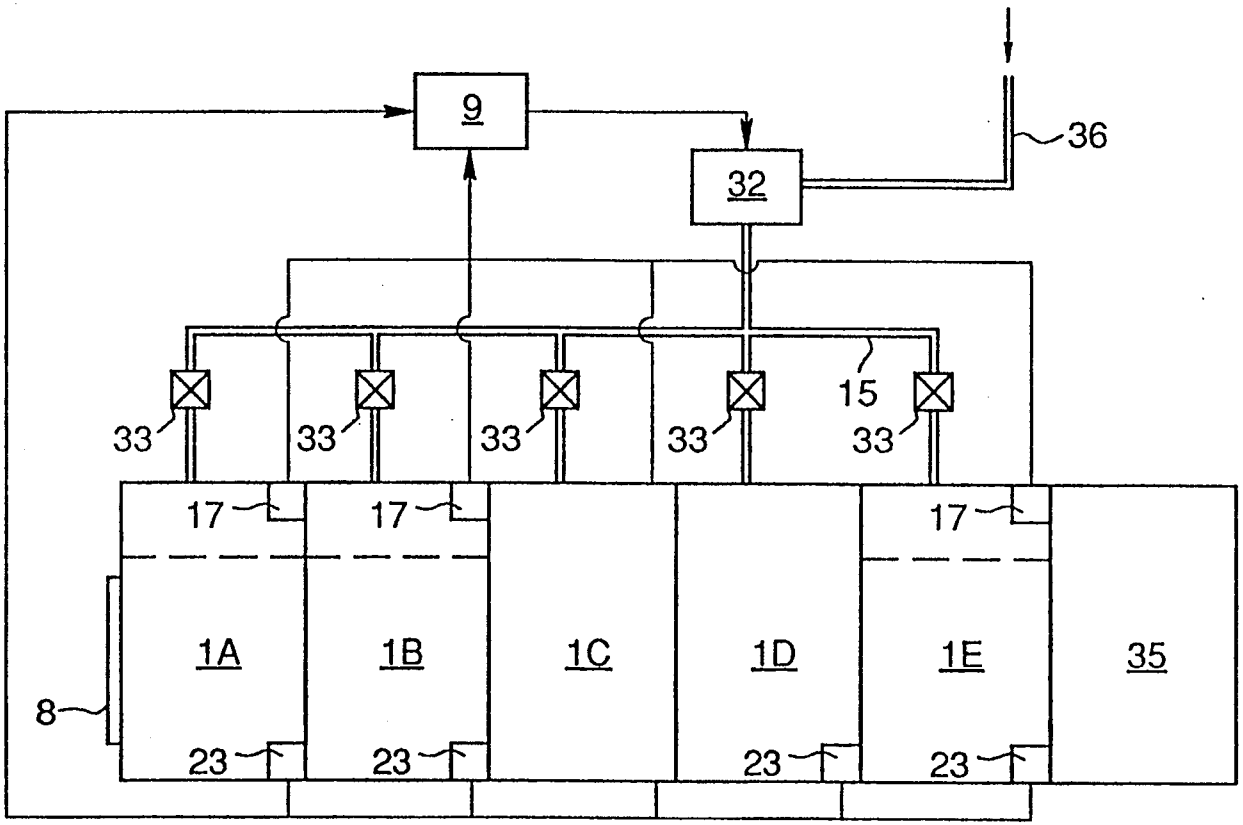
FIG. 4 is a schematic diagram of automatic developing machine A as viewed from above.
Figure 5:
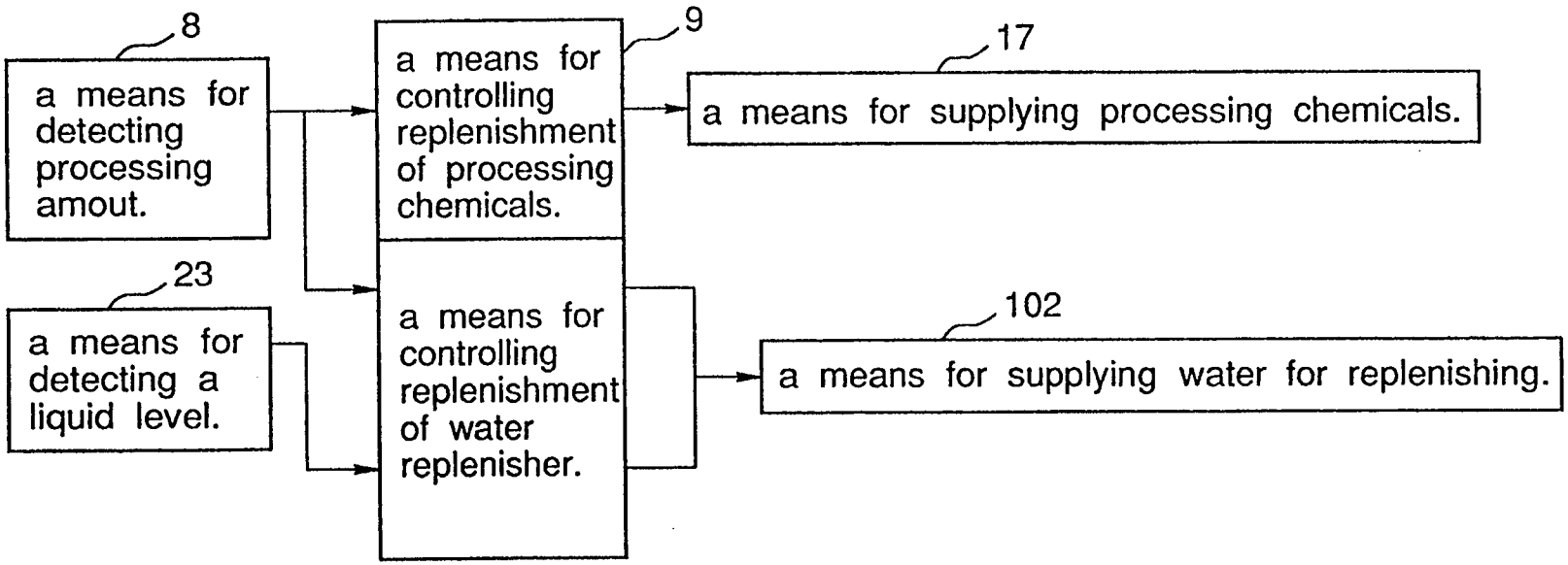
FIG. 5 is a block diagram showing the control of automatic developing machine A.

As another example of the present invention, FIG. 3 shows a schematic diagram of color developing tank 1A of automatic developing machine A of FIG. 1 as viewed on the I—I cross-section. FIG. 4 is a schematic diagram of automatic developing machine A of FIG. 1 as viewed from above (for the sake of explanation, the path for the water replenisher supplying means is illustrated). FIG. 5 is a block diagram of the control relating to this example. FIGS. 3 and 4 illustrate water replenisher tank 103 for storing replenishing water. In this example, tablet 13 is used as a solid processing agent.

With respect to FIGS. 3 and 4, the parts different from FIG. 2 are first described below.

Liquid level fall detecting means 23 is a liquid level sensor for detecting the liquid level fall in the processing solution in processing portion 2 Examples include a float switch or an electrode switch. It detects reduction in the amount of processing solution due to evaporation or carrying-over by the light-sensitive material. Liquid level fall detecting means 23 is not limited to liquid level sensor; it may be anything, as long as it is capable of directly or indirectly detecting a decrease in the volume of the processing solution in processing tank 1 from the preset level.

Water replenisher supplying means 102 is a means of supplying a water replenisher (replenishing water) from water replenisher tank 103 for storing the water replenisher to solid processing agent receiving portion 11, having warm water supplying apparatus 32, which comprises a pump, a temperature controller, etc., electromagnetic valve 33 and replenishing water supplying pipe 36. This water replenisher supplying means 102 serves two purposes: 1) the water replenisher is supplied upon detection of liquid level fall in the processing solution by liquid level fall detecting means 23, and 2) the water replenisher is supplied to promote the dissolution of the solid processing agent supplied to the processing solution, to correct the processing solution concentration and to keep the performance of the processing solution constant. Water replenishing in case 2 is particularly useful. This water replenisher supplying means 102 may be arranged separately for the above cases 1 and 2, but it is preferable that a single means of water replenishment is in charge of the two cases. In case 2, the means of supplying the water replenisher is not confined to water replenishment according to the information on the amount of processing detected by processing amount information detecting means 8; the water replenisher may of course be supplied according to the information on the supply of the processing agent by processing agent supplying means 17. Although processing tanks 1A, 1B, 1C, 1D and 1E may be each provided with a water replenishing tank and a water replenishing pump, size reduction in the automatic developing machine is possible when the same water replenisher is used for all tanks, i.e., a single water replenishing tank alone is used. It is more preferable to arrange only one water replenishing tank and one water replenishing pump and provide an electromagnetic valve in the water replenishing path (pipe etc.) so that the required amount is supplied to each processing tank where necessary, or adjust the diameter of the water replenishing pipe to regulate the replenishing rate, whereby further size reduction is realized with only one water replenishing tank and only one water replenishing pump provided in the automatic developing machine. With respect to stabilizing tanks 1C and 1D, it is possible to remove the water replenisher supplying means by supplying the stabilizer overflow from stabilizing tanks 1D and 1E, respectively. It is also preferable to warm the water replenisher in the water replenishing tank.

Waters for this replenishment include not only ordinary waters such as well water and tap water but also those containing fungicides such as isothiazoline and chlorine-releasing compounds, a small amount of sulfite chelating agent, and ammonia or inorganic salt, as long as it does not affect photographic performance.

In addition to the processing agent supply control means described above, water replenisher supply control means 9 is provided. This water replenisher supply control means controls the water replenisher supplying means upon detection of liquid level fall in the processing solution in processing portion 2 by liquid level fall detecting means 23 and/or controls the water replenisher supplying means according to the information on the amount of processing detected by processing amount information detecting means 8. The base of control by this water replenisher supply control means is not confined to the information on the amount of processing detected by processing amount information detecting means 8; it may be according to the information of supply of the processing agent by processing agent supplying means 17.

The parts of FIG. 3 different from FIG. 2, other than those described above, whose function etc. are the same as those in FIG. 2, are described below.

Heater 7, arranged in the bottom portion of processing portion 2, heats the processing solution in processing portion 2, i.e., it is a means for temperature control for retaining the processing solutions in processing portion 2 and solid processing agent receiving portion 11 in an appropriate temperature range (e.g., 25° to 55° C.).

As means of circulation, circulatory pipe 4 and circulatory pump 5 are provided in the same manner as in FIG. 2, but the direction of processing solution circulation is opposite, i.e., the processing solution is circulated in the cycle of processing portion 2 → circulatory pump 5 → solid processing agent receiving portion 11 → communicating window → processing portion 2.

Processing agent supplying means 17 supplies solidified processing agent 13, enclosed in cartridge 15, to filtering means 14 in solid processing agent receiving portion 11 by means of pusher claw 18. It is different from FIG. 2 in that cam 19 is driven by 1 axial rotation stopping mechanism to activate pusher claw 18, whereby waiting tablet 13 is supplied to processing tank 1, while the next tablet 13 quickly becomes in a waiting state since it is under pressure exerted by tablet pushing spring 26 from above to below. Processing agent supplying means 17 may also be based on the side or upward method; it may be any means, as long as it is capable of adding the solid processing agent to processing tank 1.

Next, the action of the present invention is described by means of FIGS. 1, 3, 4 and 5. With respect to the exposed light-sensitive material, information on the amount of processing is detected by processing amount information detecting means 8 at the inlet of automatic developing machine A. Processing agent supply controlling means 9 sends a supplying signal to processing agent supplying means 17 according to the information on the amount of processing detected by processing amount information detecting means 8 when the integral area of light-sensitive material processed reaches the preset level. Upon reception of supplying signal, processing agent supplying means 17 pushes out and supplies tablet 13 by means of pusher 10 to filtering portion 14 in solid processing agent receiving portion 11. Tablet 13 thus supplied is dissolved in the processing solution in solid processing agent receiving portion 11, wherein its dissolution is facilitated by the processing solution circulated by a means of circulation in the cycle of processing portion 2 → circulatory pump 5 → solid processing agent receiving portion 11 → communicating window → processing portion 2. On the other hand, the water replenisher supplying means sends a water replenishing signal to water replenisher supplying means 102 (warm water supplying apparatus 32 and electromagnetic valve 33) according to the information on the amount of processing detected by processing amount information detecting means 8 when the integral area of light-sensitive material processed reaches the preset level. Upon water replenishing signal reception, water replenisher supplying means 102 controls warm water supplying apparatus 32 and electromagnetic valve 33 to supply the specified or required amount of water replenisher stored in water replenisher tank 103 to each or appropriate processing tank. In this case, the preset level is equal to that for processing agent supply controlling means 9, but this is not limitative; the preset level may be different for the two supply means. The detected light-sensitive material is sequentially transported through color developing tank 1A, bleach-fixing tank 1B and stabilizing tanks 1C, 1D and 1E by means of a transporting roller. Upon detection of a reduction in the processing solution due to evaporation of processing solution or carry-over by the light-sensitive material by liquid level fall detecting means 23, the signal is input to the water replenisher supply controlling means. Upon signal reception, the means water replenisher supply control means sends a water replenishing signal to the water replenisher supplying means to supply the water replenisher up to the preset liquid level to the processing solution while controlling the water replenisher supplying means.

In the above description, two water replenisher supplying means 1 and 2 are provided, but it is acceptable to provide either the water replenishing means for case 1 or the water replenisher supplying means for case 2. Because the processing solution in the processing tank is kept at a given temperature, the use of the water replenishing means for case 1 alone is effective in suppressing fluctuation of processing solution properties due to fall in the processing solution level below the preset level as a result of evaporation of the processing solution when the automatic developing machine is in, or out of, operation, or carry-over of the processing solution by the light-sensitive material being transported to the next tank. The use of the water replenisher supplying means for case 2 alone is effective in promoting the dissolution of the solid processing agent supplied to the processing solution, correcting the processing solution concentration, keeping the processing solution performance constant, avoiding major concentration change in the processing solution due to supply of the solid processing agent to ensure constantly stable processing solution performance, and facilitating the overflow necessary to prevent the retention and increase of the components carried over by the light-sensitive material and the components oozing out from the light-sensitive material. When using both water replenisher supplying means for cases 1 and 2, the respective effects are combined, and additional effects are obtained in that the processing properties of the light-sensitive material for an automatic developing machine is stabilized, the two purposes of water replenishment can be accomplished by a single water replenishing means and hence by a single water replenishing tank so that further size reduction in the automatic developing machine is possible.

Figure 6:
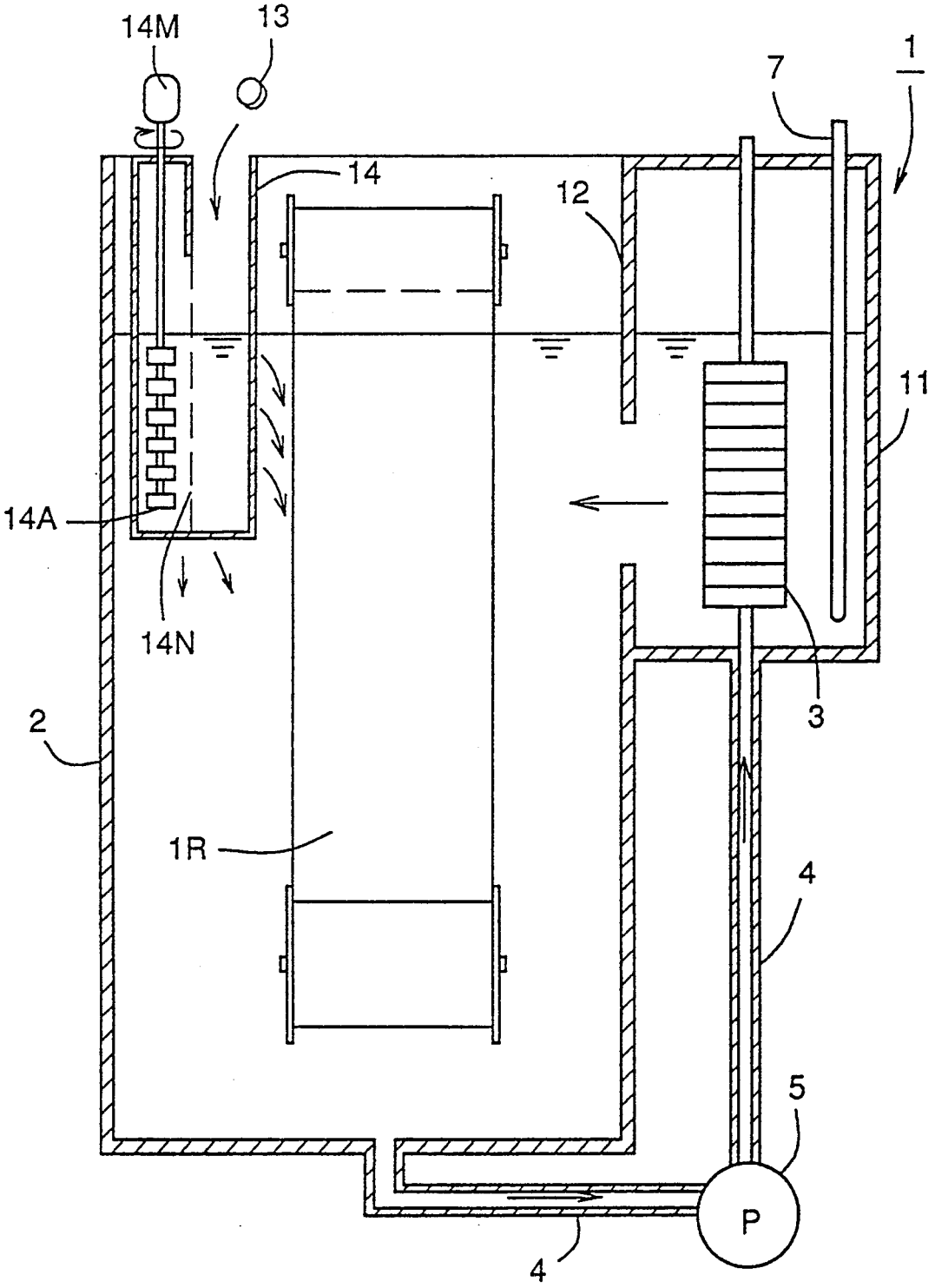
FIG. 6 is a schematic cross-sectional view of processing tank 1 of automatic developing machine A of FIG. 1.

Next, another embodiment of the present invention is described by means of FIG. 6. FIG. 6 is a schematic cross-sectional view of processing tank 1 of automatic developing machine A of FIG. 1.

The embodiment shown in FIG. 6 is different from those shown in FIGS. 2 and 3 in that the solid processing agent receiving portion to which solid photographic processing agent 13 is supplied is provided in processing portion 1 rather than outside the separating wall of processing portion 2 as described above. For the present description alone, the solid processing agent receiving portion is referred to as filtering portion 14. Also, the portion to which the processing agent is supplied in the above description is simply referred to as a path for circulating the processing solution or subtank 11 warmed for keeping the processing solution at constant temperature. Another difference is that not only circulatory pump 5, which forms a circulatory flow, but also impeller blade 14A is provided as a means of dissolving solid photographic processing agent 13 supplied to filtering portion 14 which is a solid processing agent receiving portion. Since other aspects are the same as above, they are not described herein.

In the examples described with FIGS. 2 and 3, solid photographic processing agent 13 is dissolved by a circulatory flow produced by circulatory pump 5. In FIG. 6, solid photographic processing agent 13 is dissolved by stirring by means of the impeller blade. However, the present invention is not limited to them; various other means such as those illustrated in the following Formulas 7 and 8 can also be used.

Figure 7:
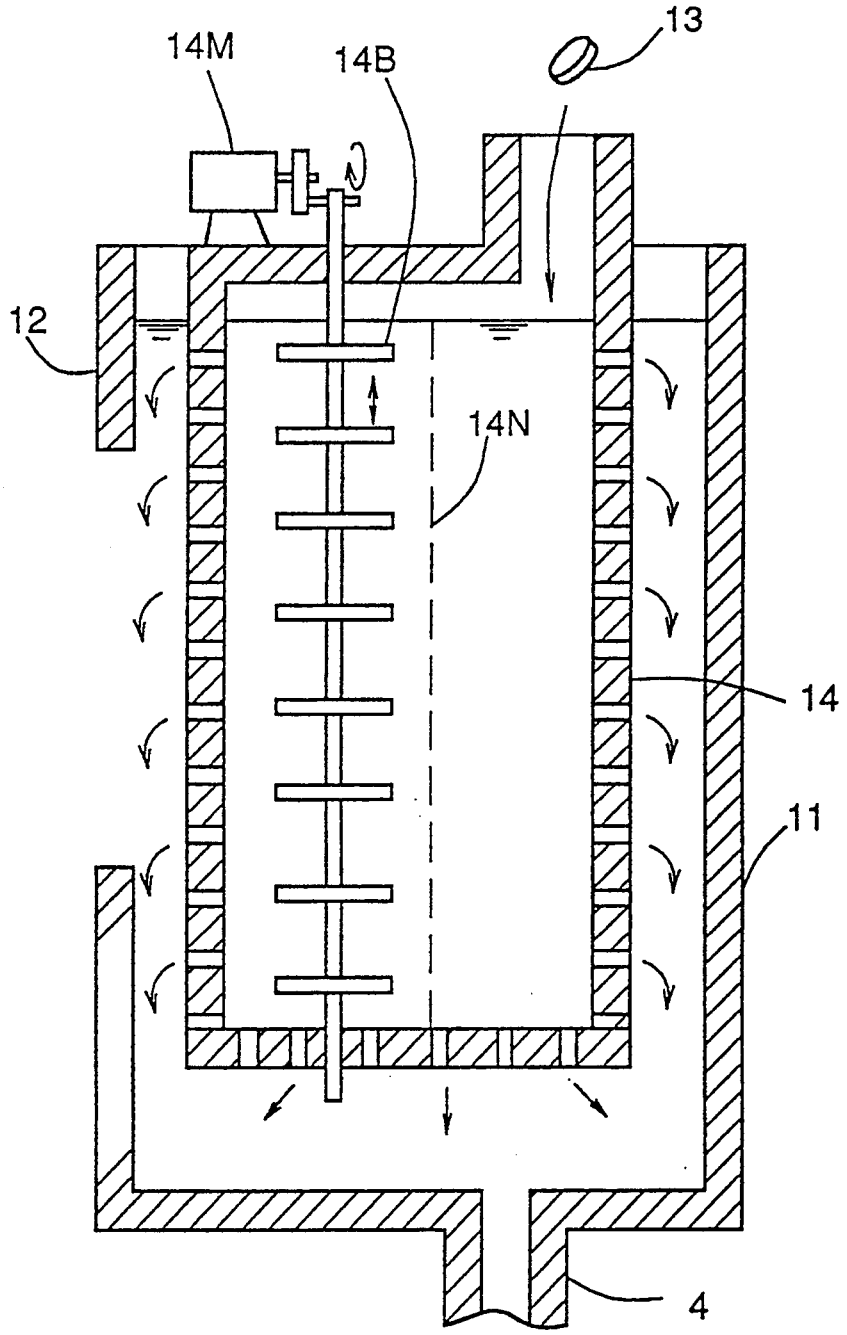
FIG. 7 is a partial cross-sectional view of a means of promoting the dissolution of a solid photographic processing agent.

FIG. 7 shows an embodiment of dissolving solid photographic processing agent 13 wherein processing solution 2 is stirred by vertically moving impeller blade 14B. Nearly the same as FIG. 6 applies except that the movement of impeller blade 14B is different from that of impeller blade 14A in FIG. 3.

Figure 8:
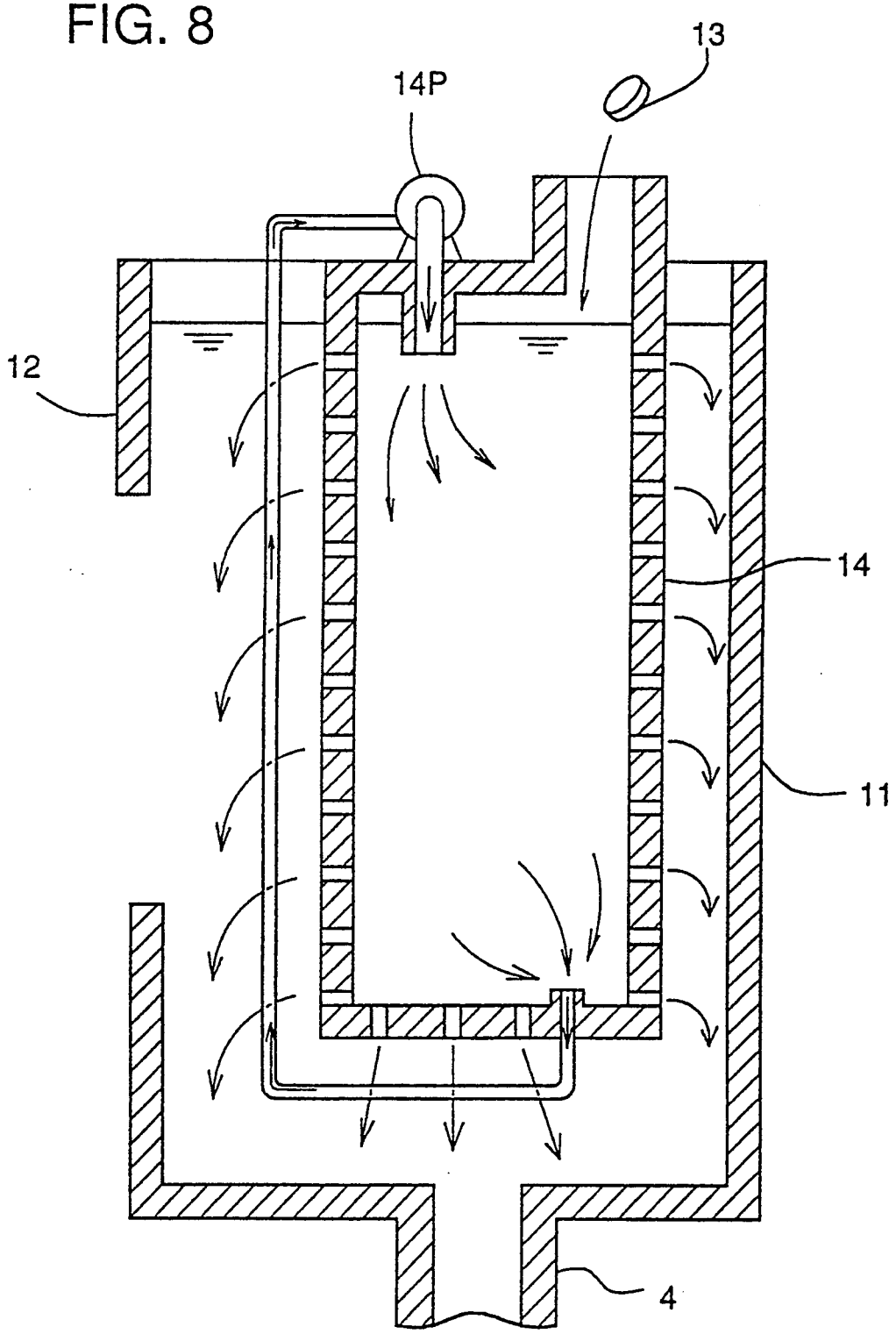
FIG. 8 is a partial cross-sectional view of another means of promoting the dissolution of a solid photographic processing agent.

FIG. 8 shows another embodiment of dissolving solid photographic processing agent 13 wherein the processing solution in filtering portion 14 is circulated by jet pump 14P for stirring arranged in filtering portion 14 in solid processing agent receiving portion 11 to produce a circulatory flow and jet flow of processing solution 2 for dissolving solid photographic processing agent 13.

Figure 9:
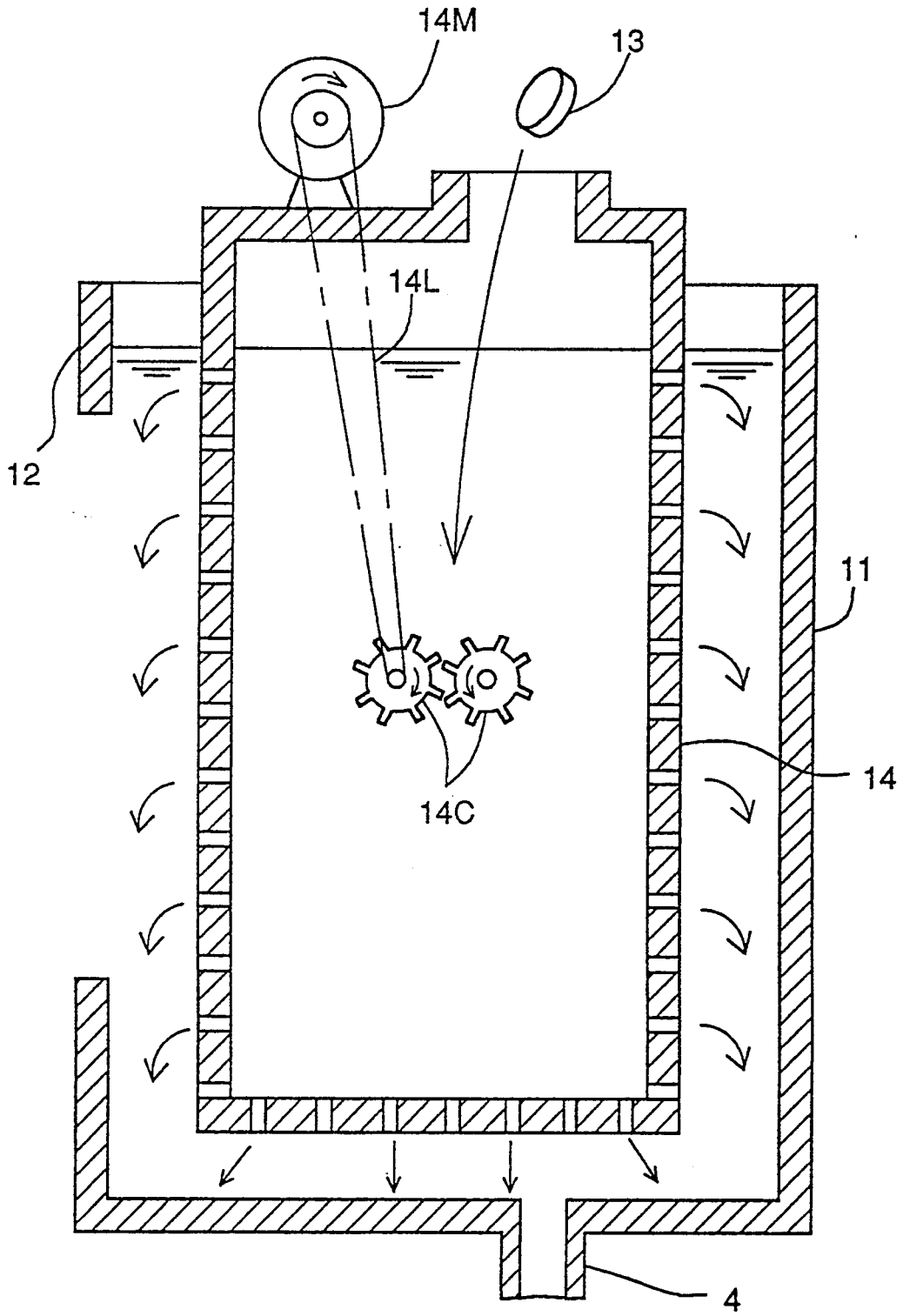
FIG. 9 is a partial cross-sectional view of another means of promoting the dissolution of a solid photographic processing agent.

FIG. 9 shows an embodiment of dissolving solid photographic processing agent 13 wherein while finely shearing, disintegrating and pulverizing solid photographic processing agent 13 fed by shearing gear 14C being rotated by motor 14M via transmitting mechanism 14L, solid photographic processing agent 13 is dissolved by stirring processing solution 2 by rotation of shearing gear 14C which also serves as a stirring means.

Figure 10:
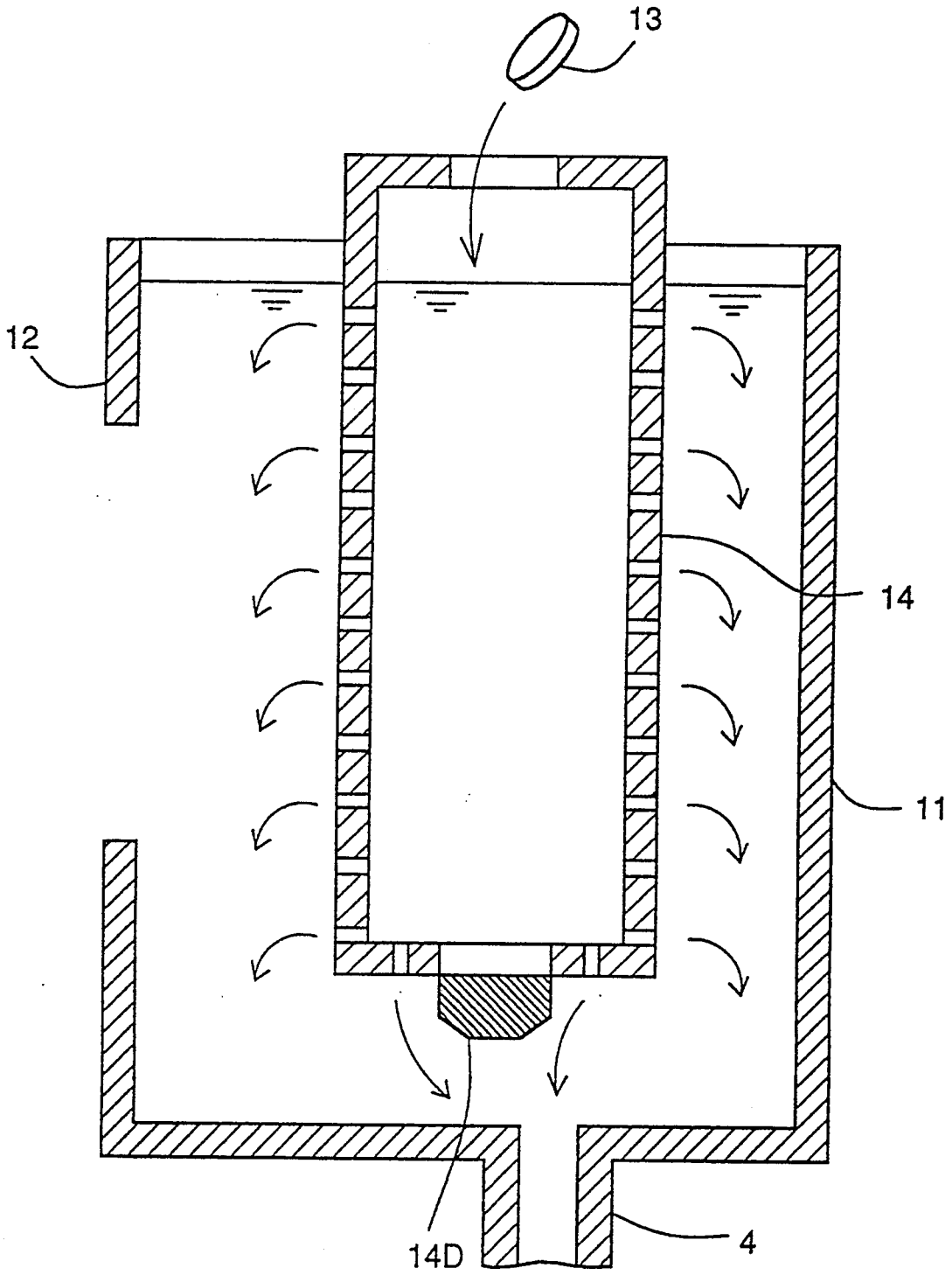
FIG. 10 is a partial cross-sectional view of another means of promoting the dissolution of a solid photographic processing agent.

FIG. 10 shows a still another embodiment of dissolving solid photographic processing agent 13 wherein solid photographic processing agent 13 is dissolved by ultrasonic micro-vibration. In the figure, 14D denotes a vibrator.

Figure 11:
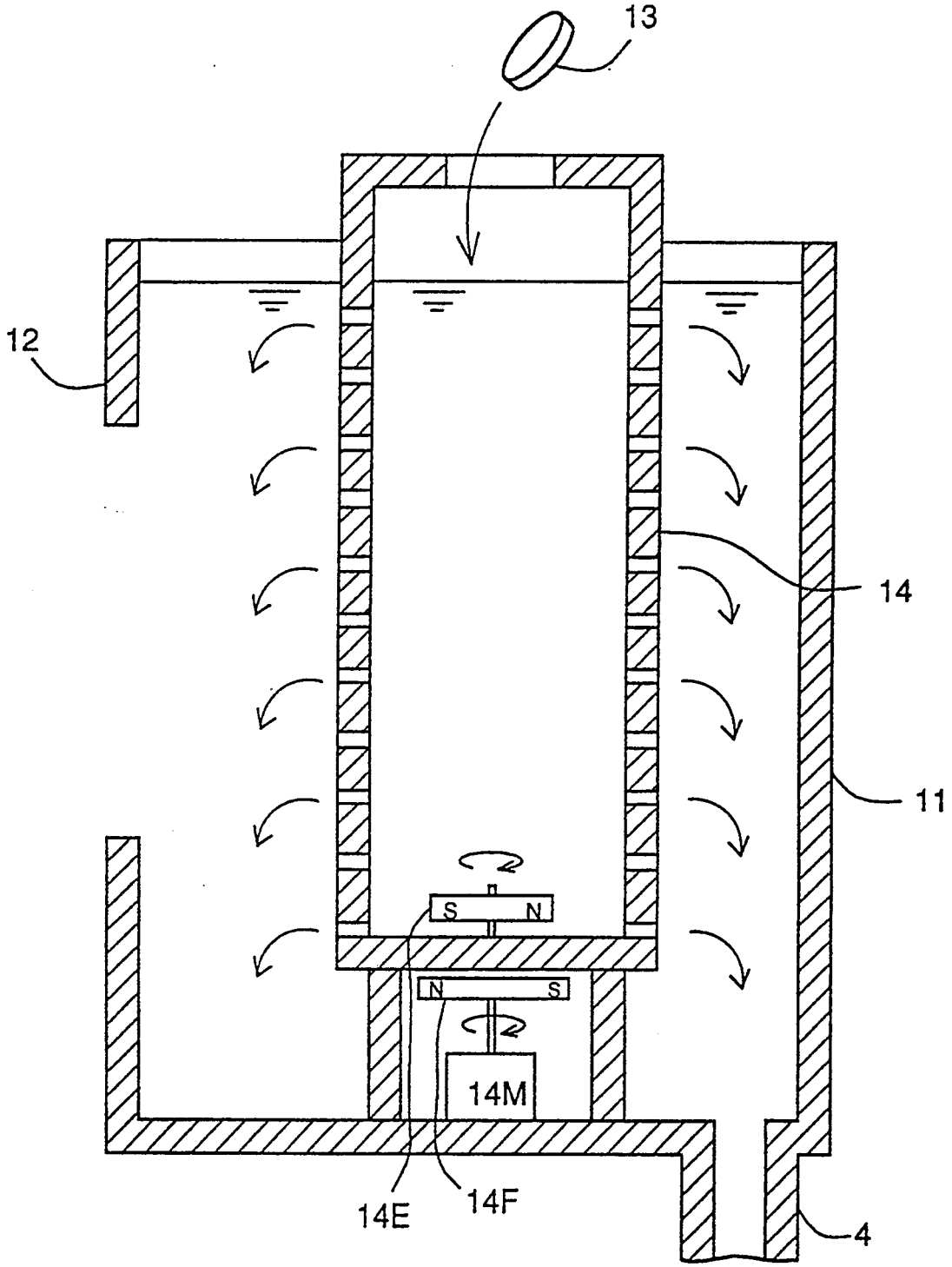
FIG. 11 is a partial cross-sectional view of another means of promoting the dissolution of a solid photographic processing agent.

FIG. 11 shows another embodiment of dissolving solid photographic processing agent 13 wherein solid photographic processing agent 13 is dissolved by stirring processing solution 2 by magnetically-rotating magnetic rotary blade 14E in the processing solution from outside of the processing solution. In the figure, motor 14M is arranged in isolation from the processing solution at a position adjoining filtering apparatus 14; by rotating rotary magnet 14F, which is attached to said motor 14M, said magnetic rotary blade 14E can be rotated in a noncontact state.

FIGS. 7 through 11 show embodiments wherein filtering portion 14, which is the dissolution portion, is arranged in solid processing agent receiving portion 11 as in FIGS. 2 and 3, but filtering portion 14 may be arranged in processing portion 2 as in FIG. 6.

Figure 12:
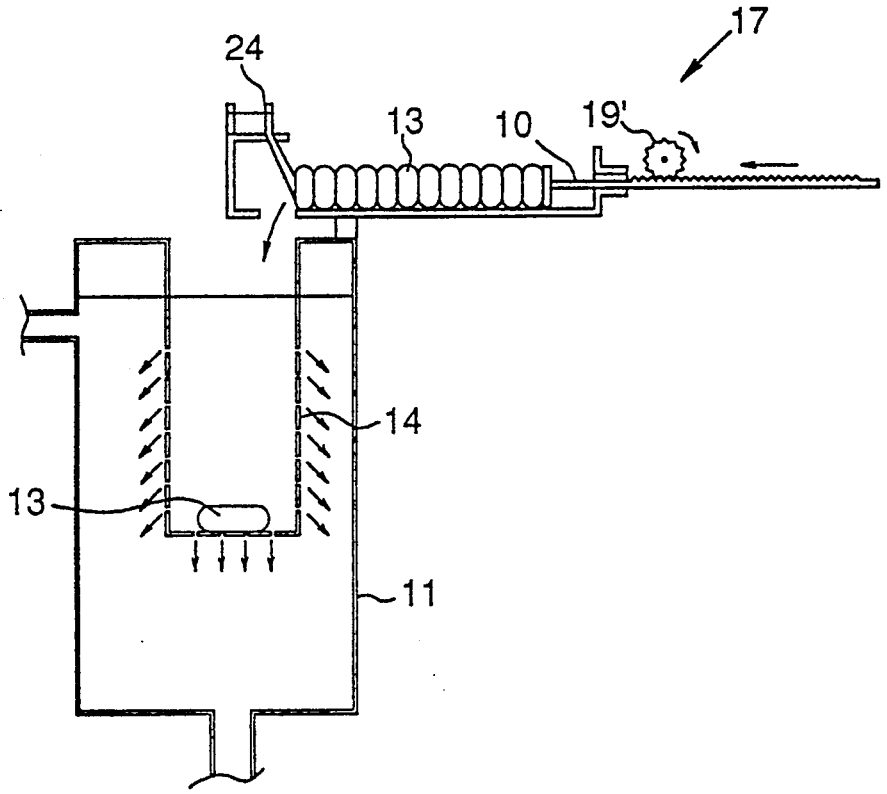
FIG. 12 is a cross-sectional view of a tableted solid photographic processing agent supplying portion.

FIG. 12 shows another embodiment of tableted solid photographic processing agent supplying portion.

Upon detection of the photographic material by means of processing amount information detecting means 8, control means 9 calculates and integrates the amount of photographic material processed and sends the integral information to processing agent supplying portion 17 and activates pinion gear 19' for a given number of rotations, whereby a rack-equipped pusher 10 pushes out one piece of solid photographic processing agent 13 against the pressure from tablet stopper 24. In short, this series of actions is based on the so-called rack-and-pinion mechanism.

The embodiment of processing agent supplying portion 17 for supplying a given number of pieces of tableted solid photographic processing agent 13 is not limited to those described above; any known mechanisms can be used for the present invention, including those described in Japanese Patent O.P.I. Publication Nos. 197309/1985, 204419/1985, 16766/1987, 97522/1988, 151887/1988 and 139066/1989. Although the above description concerns one-by-one supply of solid photographic processing agent 13, the present invention is not limited to this mode, affording supply of a plurality of pieces of solid photographic processing agent according to processing conditions.

Figure 13:
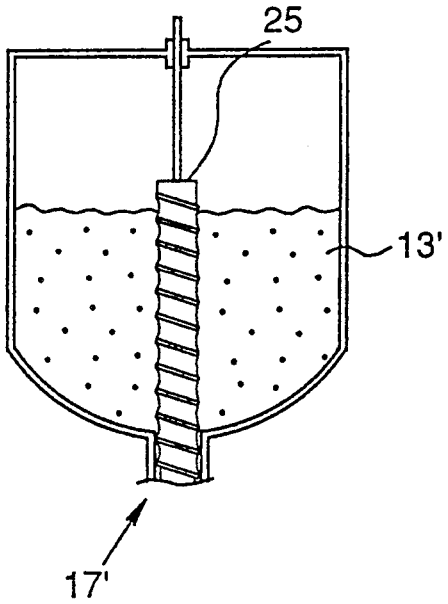
FIG. 13 is a cross-sectional view of a granular solid photographic processing agent supplying portion.
Figure 14:
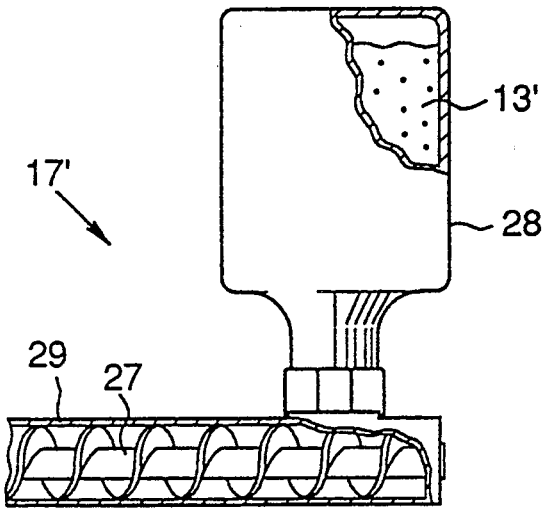
FIG. 14 is another cross-sectional view of a granular solid photographic processing agent supplying portion.

FIGS. 13 and 14 are cross-sectional views of an example of granular solid photographic processing agent supplying portion 17', wherein the granular processing agent is supplied by the action of a so-called screw pump.

In FIG. 13, granular solid photographic processing agent 13' is contained in container 26, and a given amount of granular solid photographic processing agent 13' is added to filtering portion 14, which is the dissolution portion, by rotation of screw 25 driven by a driver not illustrated. Screw 25 is rotated by a given driving force exerted upon signal reception from the processing amount information detecting means and control means 9, in the same manner as in the embodiment shown in FIG. 2.

In FIG. 14, granular solid photographic processing agent 13' is contained in container 28 and added to filtering portion 14, which is the dissolution portion, through processing agent guide 29 by rotation of screw 27.

EXAMPLES

Example 1

Solid processing agent replenishers for the present invention were prepared as follows.

1) Color Developer Replenisher for Color Negative Films

Procedure 1

3.0 g of hydroxylamine sulfate was ground in an air jet mill to obtain an average grain size of 10 $\mu$. The resulting fine powder was granulated by spraying 0.20 ml of water at room temperature for about 7 minutes in a commercially available fluidized bed spray granulator. The granulation product obtained was dried at 63° C. air temperature for 8 minutes and then dried at 40° C. in a vacuum for 90 minutes to remove almost all the water from the granulation product.

Procedure 2

6.0 g of the developing agent CD-4 [4-amino-3-methyl-N-ethyl-N-$\beta$-hydroxylethyl)aniline sulfate] was milled in an air jet mill and then granulated in the same manner as procedure 1. The amount of water sprayed was 0.2 ml. Granulation was followed by drying at 60° C. for 7 minutes. Next, the granulation product was dried at 40° C. in a vacuum for 90 minutes to remove almost all the water therefrom.

Procedure 3

2.5 g of sodium 1-hydroxyethane-1,1-diphosphonate, 1.75 g of sodium sulfite, 15.4 g of potassium carbonate, 0.75 g of sodium hydrogen carbonate and 0.35 g of sodium bromide were uniformly mixed in a commercially available mixer, after which they were milled in an air jet mill and then granulated in the same manner as procedure 1. The amount of water sprayed was 5.5 ml. Granulation was followed by drying at 70° C. for 10 minutes. Next, the granulation product was dried at 40° C. in a vacuum for 90 minutes to remove almost all the water therefrom.

Procedure 4

1.75 g of sodium sulfite, 2.0 g of sodium diethylenetriaminepentaacetate, 15.4 g of potassium carbonate, 0.75 g of sodium hydrogen carbonate and 0.35 g of sodium bromide were granulated in the same manner as procedure 3. The amount of water sprayed was 5.75 ml. Granulation was followed by drying at 80° C. for 10 minutes.

Procedure 5

The granulation products obtained in the above procedures 1 through 4 were uniformly mixed in a mixer for about 10 minutes in a room conditioned at 25° C. temperature and not more than 50% relative humidity. The resulting mixture was solidified using a solid processing agent tableting machine, a modification of Tough Press Correct 1527HU, produced by Kikusui Seisakusho. In performing solidification, 5.00 g of the above mixture was filled and formed in the solid processing agent tableting machine under a compressive pressure of 800 kg/cm$^2$. This procedure was repeated in cycles to obtain a total of 10 pieces of solid color developer replenisher for color films from the mixture.

2) Bleacher Replenisher

Procedure 6

90 g of potassium ferric 1,3-propylenediaminetetraacetate, 20 g of sodium ferric ethylenediaminetetraacetate, 2.5 g of sodium ethylenediaminetetraacetate and 2.5 g of sodium hydrogen carbonate were granulated in the same manner as procedure 3. The amount of water sprayed was 27.5 ml. Granulation was followed by drying at 80° C. for 10 minutes.

Procedure 7

150 g of potassium bromide, 17.5 g of sodium nitrate and 14.5 g of sodium acetate were granulated in the same manner as procedure 3. The amount of water sprayed was 25 ml. Granulation was followed by drying at 77° C. for 10 minutes.

Procedure 8

The granulation products obtained in the above procedures 6 and 7 were mixed and then solidified in the same manner as procedure 5 except that the amount of mixture filled in the solid processing agent tableting machine was 5.94 g, to obtain a total of 50 pieces of solid bleacher replenisher for color negative films.

3) Fixer Replenisher

Procedure 9

150 g of sodium thiosulfate, 10 g of sodium sulfite, 37.5 g of potassium thiocyanate, 1.0 g of sodium ethylenediaminetetraacetate and 1.0 g of sodium hydrogen carbonate were granulated in the same manner as procedure 3. The amount of water sprayed was 12.0 ml. Granulation was followed by drying at 77° C. for 10 minutes.

Procedure 10

The granulation product obtained in the above procedure 9 was solidified in the same manner as in procedure 5 except that the amount of mixture filled in the solid processing agent tableting machine was 9.96 g, to obtain a total of 25 pieces of solid fixer replenisher for color negative films.

4) Stabilizer Replenisher

Procedure 11

3.0 g of hexamethylenetetramine, 2.0 g of polyethylene glycol (molecular weight 1540), 0.05 g of 1,2-benzisothiazolon-3-one, 0.12 g of polyvinylpyrrolidone (degree of polymerization approximately 17) and 0.35 g of sodium hydrogen carbonate were granulated in the same manner as procedure 3. The resulting granulation product was further granulated at room temperature for about 20 minutes while spraying 6 g of the following compound:

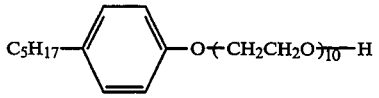

After drying at 65° C. air temperature for 10 minutes, the granulation product was further dried at 40° C. in a vacuum for 90 minutes.

Procedure 12

The granulation product obtained in the above procedure 11 was solidified in the same manner as in procedure 5 except that the amount of mixture filled in the solid processing agent tableting machine was 0.354 g, to obtain 17 pieces of solid stabilizer replenisher for color negative films.

5) Color Developer Replenisher for Color Printing Paper

Procedure 13

4.8 g of diethylhydroxylamine oxalate and 1.32 g of sodium hydrogen carbonate were granulated in the same manner as in procedure 1. The amount of water sprayed was 0.25 ml. Granulation was followed by drying at 70° C. for 70 minutes.

Procedure 14

6.48 g of the developing agent CD-3 [1-(N-ethyl-N-methanesulfonamidoethyl)-3-methyl-p-phenylenediamine sesquisulfate monohydrate was granulated in the same manner as procedure 2. The amount of water sprayed was 0.22 ml. Granulation was followed by drying at 63° C. for 8 minutes.

Procedure 15

0.144 g of sodium sulfite, 10.8 g of potassium carbonate, 0.54 g of sodium hydrogen carbonate and 1.8 g of Tinopal SFP were granulated in the same manner as procedure 3. The amount of water sprayed was 3.36 ml. Granulation was followed by drying at 73° C. for 10 minutes.

Procedure 16

10.8 g of potassium carbonate, 2.88 g of sodium diethylenetriaminepentaacetate, 0.54 g of sodium hydrogen carbonate and 1.44 g of Pullulonic F-68 (produced by Asahi Denka Kogyo) were granulated in the same manner as procedure 3. The amount of water sprayed was 3.12 ml. Granulation was followed by drying at 73° C. for 10 minutes.

Procedure 17

The granulation products obtained in the above procedures 13 through 16 were mixed and then solidified in a solid processing agent tableting machine in the same manner as procedure 5 except that the amount of mixture filled in the solid processing agent tableting machine was 6.924 g, to obtain 6 pieces of solid color developer replenisher for color printing paper.

6) Bleach-Fixing Agent for Color Printing Paper

Procedure 18

71.5 g of sodium ferric ethylenediaminetetraacetate, 1.3 g of ethylenediaminetetraacetic acid and 0.75 g of sodium hydrogen carbonate were granulated in the same manner as procedure 3. The amount of water sprayed was 7.9 ml. Granulation was followed by drying at 80° C. for 10 minutes.

Procedure 19

87.5 g of sodium thiosulfate, 32.5 g of ammonium thiocyanate, 26 g of ammonium sulfite, 3.25 g of sulfinic acid, 6.5 g of potassium bromide and 0.7 g of sodium hydrogen carbonate were granulated in the same manner as procedure 3. The amount of water sprayed was 8.75 ml. Granulation was followed by drying at 77° C. for 10 minutes.

Procedure 20

The granulation products obtained in the above procedures 18 and 19 were mixed and then solidified in the same manner as procedure 5 except that the amount of mixture filled in the solid processing agent tableting machine was 38.33 g, to obtain 6 pieces of solid bleach-fixer replenisher for color printing paper.

7) Stabilizer for Color Printing Paper

Procedure 21

0.04 g of 1,2-benzisothiazolin-3-one, 0.65 g of 1-hydroxyethylidene-1,1-diphosphonic acid, 1.3 g of ethylenediaminetetraacetic acid, 2.60 g of Tinopal SFP (produced by CIBA-GEIGY), 3.26 g of ammonium sulfate, 1.3 g of zinc chloride, 0.6 g of magnesium chloride, 1.3 g of o-phenylphenol, 2.6 g of ammonium sulfite and 1.0 g of sodium hydrogen carbonate were granulated in the same manner as procedure 3. The amount of water sprayed was 3.0 ml. Granulation was followed by drying at 65° C. for 10 minutes.

Procedure 22

The resulting granulation product was solidified in the same manner as procedure 5 except that the amount of granulation product filled in the solid processing agent tableting machine was 2.93 g, to obtain 5 pieces of solid stabilizer replenisher for color printing paper. Next, the solid replenishers obtained above were each subjected to a dissolution test. The numbers of solid replenishers for color negative films and those for color printing paper used in the dissolution test are given below.

For color negative films
- Color developer replenisher T3 10
- Bleacher replenisher T3 50
- Fixer replenisher T3 25
- Stabilizer replenisher T3 17

For color printing paper
- Color developer replenisher T3 6
- Bleach-fixer replenisher T3 6
- Stabilizer replenisher T3 5

The tablets prepared by the above method, starting powders and liquid preparations were evaluated as to storage stability. Liquid preparations were obtained as follows.

For color negative films
- Color developer replenisher: 5 pieces were dissolved in water and diluted to 500 ml.
- Bleacher replenisher: 25 pieces were dissolved in water and diluted to 500 ml.
- Fixer replenisher: 10 pieces were dissolved in water and diluted to 400 ml.
- Stabilizer replenisher: 7 pieces were dissolved in water and diluted to 400 ml.

For color printing paper
- Color developer replenisher: 3 pieces were dissolved in water and diluted to 500 ml.
- Bleach-fixer replenisher: 3 pieces were dissolved in water and diluted to 500 ml.
- Stabilizer replenisher: 2 pieces were dissolved in water and diluted to 400 ml.

The tablets, powders and liquids were each enclosed in a polyethylene bag and placed in a 50° C. thermal cycler. 2 weeks and 4 weeks later, they were taken out. The tablets and powders were dissolved and the degree of discoloration was evaluated. The tablets were dissolved in the same manner as above.

The results are shown in Table 1.

TABLE 1

| | Processing agent | Replenisher form | Evaluation after thermal storage: After 2 weeks | Evaluation after thermal storage: After 4 weeks |
|---|---|---|---|---|
| For color films | Color developer replenisher | Liquid | C | C |
| | | Powder | A | C |
| | | Tablet | A | A |
| | Bleacher replenisher | Liquid | C | C |
| | | Powder | A | C |
| | | Tablet | A | A |
| | Fixer replenisher | Liquid | C | C |
| | | Powder | A | B |
| | | Tablet | A | A |
| | Stabilizer replenisher | Liquid | C | C |
| | | Powder | A | C |
| | | Tablet | A | A |
| For color printing paper | Color developer replenisher | Liquid | C | C |
| | | Powder | A | C |
| | | Tablet | A | A |
| | Fixer replenisher | Liquid | C | C |
| | | Powder | A | B |
| | | Tablet | A | A |
| | Stabilizer replenisher | Liquid | C | C |
| | | Powder | A | B |
| | | Tablet | A | A |

A: No discoloration
B: Partial discoloration
C: Total discoloration

From the results given in Table 1, it is evident that the solid processing agents, particularly tablet processing agents, according to the present invention have good discoloration resistance than emulsions. This discoloration resistance serves as an index of evaluating the storage stability parameters of processing agents, such as chemical change.

EXAMPLE 2

The processing method for light-sensitive materials using the automatic developing machine of the present invention is described below.

The Konica color negative film processor CL-KP-50QA was modified, except for the replenisher tanks, to have the controlling, solid replenisher supplying, liquid level detecting, warm water supplying and other functions shown in FIGS. 3 and 5, and was used to conduct the following experiment.

Standard processing conditions for the automatic developing machine are shown below.

| Processing procedure | Temperature | Time |
|---|---|---|
| Color development | 38.0 ± 0.3° C. | 3 minutes 15 seconds |
| Bleaching | 38.0 ± 1.0° C. | 50 seconds |
| Fixation 1 | 38.0 ± 1.0° C. | 50 seconds |
| Fixation 2 | 38.0 ± 1.0° C. | 50 seconds |
| Stabilization 1 | 38.0 ± 3.0° C. | 24 seconds |
| Stabilization 2 | 38.0 ± 3.0° C. | 24 seconds |
| Stabilization 3 | 38.0 ± 3.0° C. | 24 seconds |
| Drying | 60° C. | 1 minute |

The replenisher was supplied by the cascade method, wherein it was first supplied to the third stabilizing tank, and the overflow was allowed to flow into the second and then first tanks.

The processing solutions for the automatic developing machine were prepared as follows.

a. Color Developer Tank Solution (21.0 1)

15 liters of warm water at 35° C. was added to the color developing tank of the automatic developing machine, in which 170 pieces of a solid color developer replenisher for color negative films prepared in the same manner as in Example 1 were dissolved. After 21 pieces of a separately solidified starter with the following compositions were added and completely dissolved, water was added up to the tank marker line to obtain a finished tank solution.

| Color negative film color development starter | |
|---|---|
| Sodium bromide | 0.2 g |
| Sodium iodide | 2.0 mg |
| Sodium hydrogen carbonate | 1.5 g |
| Potassium carbonate | 2.4 g |

b. Bleacher (5.0 1)

3.0 liters of warm water at 35° C. was added to the bleaching tank of the automatic developing machine, in which 250 pieces of a solid bleacher replenisher for color negative films prepared in the same manner as in Example 1 were dissolved. After 5 pieces of a separately solidified starter with the following compositions were added and completely dissolved, water was added up to the tank marker line to obtain a finished tank solution.

| Color negative film bleaching starter | |
|---|---|
| Potassium bromide | 20 g |
| Sodium hydrogen carbonate | 3 g |
| Potassium carbonate | 7 g |

c. Fixer (9 1)

3.0 liters of warm water at 35° C. was added to each of the first and second fixing tanks of the automatic developing machine, in which 112 pieces of a solid fixer replenisher for color negative films prepared in the same manner as in Example 1 were dissolved. Next, water was added up to the tank marker line to obtain a finished tank solution.

d. Stabilizer (3.2 1 for Each of the First, Second and Third Tanks)

3.0 liters of warm water at 35° C. was added to each of the first, second and third stabilizing tanks of the automatic developing machine, in which 53 pieces of a solid stabilizer replenisher for color negative films prepared in the same manner as in Example 1 were dissolved. Next, water was added up to the tank marker line to obtain a finished tank solution. Next, while warming the automatic developing machine, 10 pieces of each solid replenisher prepared in Example 1 were taken out from the polyethylene bag and set to the solid processing agent replenisher supplying apparatus 17 illustrated in FIGS. 1 and 3.

The setting was such that one piece of this replenisher was added upon processing of 2 rolls of 135-sized film for 24 shots as detected by light-sensitive material area detection sensor 8 and simultaneously water replenisher supplying apparatus 32 and electromagnetic valve 33 were activated to supply the water replenisher in amounts of 100 ml, 20 ml, 40 ml and 60 ml to color developing tank 1, bleaching tank, fixing tank B and stabilizing tank B, respectively. The setting was also such that liquid level sensor 23 was activated via controller 9 to activate water replenisher supplying apparatus 32 and electromagnetic valve 33 in response to a fall of not less than 1 cm in liquid level in each processing tank due to evaporation of each processing solution while the film remained unprocessed, to supply the water replenisher until the preset level of the solution in each processing tank was reached.

After exposure, 20 rolls per day of the Konica Color Super DD100 film were processed for 1 month, using the automatic developing machine described above, to evaluate the storage stability.

For comparison, the conventional method was evaluated, in which replenishers were prepared in replenisher tanks and supplied via respective bellows pumps. The replenishers used were prepared by dissolving the tablets for color negative films described in Example 1 (10 pieces of color developer replenisher, 50 pieces of bleacher replenisher, 25 pieces of fixer replenisher, 17 pieces of stabilizer replenisher) in water and diluted to 1 liter. The amount of replenisher per roll of the 135-sized film for 24 shots was 50 ml of color developer replenisher, 10 ml of bleacher replenisher, 20 ml of fixer replenisher and 30 ml of stabilizer replenisher.

The water replenisher supplying setting was such that upon liquid level fall of not less than 1 cm below the preset level in the processing tank due to evaporation of the processing solution while the film remained unprocessed, the water replenisher supplying apparatus and the electromagnetic valve were activated to supply the water replenisher until the liquid level in the processing tank returned to the preset level.

Photographic performance stability was evaluated by processing the control strip CNK-4 for the top and for every 20 rolls to determine photographic image density and by sampling the processing solution every 10 days and analyzing the processing solution composition for the items shown in Table 2.

Tables 2 and 3 show the results of photographic density determination and analytical results for the processing solution composition.

From the results shown in Tables 2 and 3, it is evident that the inventive processing is stabler than the conventional processing, having less fluctuation in photographic performance and processing solution composition.

-continued

| Processing procedure | Temperature | Time |
|---|---|---|
| Drying | 72.5 ± 5.0° C. | 40 seconds |

The replenisher was supplied by the cascade method, wherein it was first supplied to the third stabilizing tank, and the overflow was allowed to flow into the second and then first tanks.

The processing solutions for automatic developing machine were prepared as follows.

TABLE 2

| | Inventive processing | | | | | | | | | Conventional processing | | | | | | | | |
|---|---|---|---|---|---|---|---|---|---|---|---|---|---|---|---|---|---|---|
| | Dmin | | | HD | | | Dmax | | | Dmin | | | HD | | | Dmax | | |
| | B | G | R | B | G | R | B | G | R | B | G | R | B | G | R | B | G | R |
| TOP | 0.59 | 0.55 | 0.23 | 2.04 | 1.80 | 1.41 | 2.95 | 2.50 | 2.05 | 0.60 | 0.56 | 0.24 | 2.04 | 1.80 | 1.41 | 2.95 | 2.50 | 2.05 |
| After 20 runs | 0.59 | 0.55 | 0.23 | 2.04 | 1.80 | 1.41 | 2.95 | 2.50 | 2.05 | 0.60 | 0.56 | 0.24 | 2.04 | 1.80 | 1.41 | 2.95 | 2.50 | 2.05 |
| After 40 runs | 0.59 | 0.55 | 0.23 | 2.04 | 1.80 | 1.41 | 2.95 | 2.50 | 2.05 | 0.60 | 0.56 | 0.24 | 2.04 | 1.80 | 1.41 | 2.95 | 2.50 | 2.05 |
| After 60 runs | 0.59 | 0.55 | 0.23 | 2.04 | 1.80 | 1.41 | 2.95 | 2.50 | 2.04 | 0.60 | 0.57 | 0.24 | 2.04 | 1.80 | 1.41 | 2.95 | 2.50 | 2.05 |
| After 80 runs | 0.59 | 0.55 | 0.23 | 2.04 | 1.80 | 1.41 | 2.94 | 2.50 | 2.04 | 0.61 | 0.57 | 0.25 | 2.05 | 1.81 | 1.42 | 2.96 | 2.50 | 2.06 |
| After 100 runs | 0.59 | 0.55 | 0.23 | 2.04 | 1.80 | 1.41 | 2.94 | 2.50 | 2.04 | 0.61 | 0.57 | 0.25 | 2.05 | 1.81 | 1.42 | 2.96 | 2.51 | 2.06 |
| After 120 runs | 0.59 | 0.55 | 0.23 | 2.04 | 1.80 | 1.41 | 2.94 | 2.50 | 2.04 | 0.61 | 0.57 | 0.25 | 2.06 | 1.82 | 1.42 | 2.97 | 2.51 | 2.06 |
| After 140 runs | 0.58 | 0.55 | 0.23 | 2.04 | 1.80 | 1.41 | 2.94 | 2.50 | 2.04 | 0.61 | 0.58 | 0.26 | 2.06 | 1.82 | 1.42 | 2.97 | 2.51 | 2.07 |
| After 160 runs | 0.58 | 0.55 | 0.23 | 2.04 | 1.80 | 1.41 | 2.94 | 2.50 | 2.04 | 0.62 | 0.58 | 0.26 | 2.06 | 1.82 | 1.42 | 2.97 | 2.52 | 2.07 |
| After 180 runs | 0.58 | 0.55 | 0.23 | 2.04 | 1.80 | 1.41 | 2.94 | 2.50 | 2.04 | 0.62 | 0.59 | 0.26 | 2.07 | 1.82 | 1.43 | 2.80 | 2.52 | 2.07 |
| After 200 runs | 0.59 | 0.55 | 0.23 | 2.04 | 1.80 | 1.41 | 2.95 | 2.50 | 2.04 | 0.63 | 0.59 | 0.26 | 2.07 | 1.83 | 1.43 | 2.80 | 2.52 | 2.07 |
| After 220 runs | 0.59 | 0.55 | 0.23 | 2.04 | 1.80 | 1.41 | 2.95 | 2.50 | 2.04 | 0.63 | 0.59 | 0.27 | 2.07 | 1.83 | 1.43 | 2.80 | 2.53 | 2.08 |
| After 240 runs | 0.59 | 0.55 | 0.23 | 2.04 | 1.80 | 1.41 | 2.95 | 2.50 | 2.04 | 0.64 | 0.60 | 0.27 | 2.08 | 1.84 | 1.43 | 2.81 | 2.53 | 2.08 |
| After 260 runs | 0.59 | 0.55 | 0.23 | 2.04 | 1.80 | 1.41 | 2.96 | 2.50 | 2.04 | 0.64 | 0.60 | 0.27 | 2.08 | 1.84 | 1.44 | 2.81 | 2.53 | 2.08 |
| After 280 runs | 0.59 | 0.55 | 0.23 | 2.04 | 1.80 | 1.41 | 2.96 | 2.50 | 2.04 | 0.65 | 0.61 | 0.27 | 2.09 | 1.89 | 1.44 | 2.81 | 2.53 | 2.08 |
| After 300 runs | 0.59 | 0.55 | 0.23 | 2.04 | 1.80 | 1.41 | 2.96 | 2.50 | 2.04 | 0.65 | 0.61 | 0.27 | 2.09 | 1.89 | 1.44 | 2.81 | 2.53 | 2.08 |

Dmin indicates minimum density; HD, shoulder density; Dmax, maximum density; B, blue filter density; G, green filter density; and R, red filter density.

TABLE 3

| | CD | | | | BL | | | Fix | STAB* |
|---|---|---|---|---|---|---|---|---|---|
| | pH | Specific gravity | NaBr (g/l) | CD-4 (g/l) | pH | Specific gravity | NH4Br (g/l) | Specific gravity | Specific gravity |
| | | | | | (1/2) Inventive processing | | | | |
| TOP | 10.05 | 1.034 | 1.15 | 4.60 | 4.38 | 1.154 | 150 | 1.135 | 1.001 |
| After 100 runs | 10.05 | 1.035 | 1.16 | 4.62 | 4.40 | 1.156 | 152 | 1.137 | 1.010 |
| After 200 runs | 10.05 | 1.036 | 1.16 | 4.62 | 4.41 | 1.158 | 153 | 1.139 | 1.012 |
| After 300 runs | 10.05 | 1.036 | 1.16 | 4.63 | 4.42 | 1.160 | 153 | 1.140 | 1.014 |
| | | | | | (2/2) Conventional processing | | | | |
| TOP | 10.05 | 1.034 | 1.15 | 4.60 | 4.38 | 1.154 | 150 | 1.135 | 1.001 |
| After 100 runs | 10.04 | 1.036 | 1.18 | 4.70 | 4.40 | 1.160 | 163 | 1.139 | 1.012 |
| After 200 runs | 10.03 | 1.038 | 1.20 | 4.80 | 4.41 | 1.170 | 171 | 1.143 | 1.018 |
| After 300 runs | 10.02 | 1.040 | 1.22 | 4.86 | 4.42 | 1.175 | 180 | 1.147 | 1.020 |

*STAB indicates the measurement for the first tank

CD, color developer; BL, bleacher; Fix, fixer; STAB, stabilizer; NaBr, sodium bromide; $NH_4Br$, ammonium bromide; and CD-4, color developing agent.

EXAMPLE 3

The Konica color QA paper type A-2 printer processor CL-PP718 was modified to have the controlling, solid replenisher supplying, liquid level detecting, warm water supplying and other functions in the same manner as in Example 2, and was used to conduct the following running test for 30 days. Standard processing conditions for the automatic developing machine are shown below.

| Processing procedure | Temperature | Time |
|---|---|---|
| Color development | 35.0 ± 0.3° C. | 45 seconds |
| Bleach-fixation | 35.0 ± 1.0° C. | 45 seconds |
| Stabilization 1 | 33.0 ± 3.0° C. | 30 seconds |
| Stabilization 2 | 33.0 ± 3.0° C. | 30 seconds |
| Stabilization 3 | 33.0 ± 3.0° C. | 30 seconds |

a. Color Developer Tank Solution (23 1)

18 liters of warm water at 35° C. was added to the color developing tank of the automatic developing machine, in which 97 pieces of a solid color developer replenisher for color printing paper prepared in the same manner as in Example 1 were dissolved. After 23 pieces of a separately solidified starter with the following composition were added and completely dissolved, water was added up to the tank marker line to obtain a finished tank solution. Color development starter for color printing paper

| Color development starter for color printing paper | |
|---|---|
| Potassium chloride | 4.0 g |
| Potassium hydrogen carbonate | 4.8 g |

-continued

| Color development starter for color printing paper | |
|---|---|
| Potassium carbonate | 2.1 g |

b. Bleach-Fixer (23 1)

15 liters of warm water at 35° C. was added to the bleach-fixing tank of the automatic developing machine, in which 138 pieces of a solid bleach-fixer replenisher for color printing paper prepared in the same manner as in Example 1 were dissolved. After 23 pieces of a separately solidified starter with the following composition were added and completely dissolved, water was added up to the tank marker line to obtain a finished tank solution.

| Color printing paper bleach-fixation starter | |
|---|---|
| Sodium hydrogen carbonate | 3 g |
| Potassium carbonate | 12 g |

C. Stabilizer (15 1 for Each of the First, Second and Third Tanks)

12 liters of warm water at 35° C. Was added to each of the first, second and third stabilizing tanks of the automatic developing machine, in which 60 pieces of a solid fixer replenisher for color printing paper prepared in the same manner as in Example 1 were added and dissolved. Next, water was added up to the tank marker line to obtain a finished tank solution. Next, while warming the automatic developing machine, 10 pieces of each solid replenisher prepared in Example 1 were taken out from the polyethylene bag and set to processing agent replenisher supplying apparatus 17. The setting was such that one unit of this replenisher was added upon processing of 1 $m^2$ of color printing paper as detected by light-sensitive material area detection sensor 8 and simultaneously water replenisher supplying apparatus 32 and electromagnetic valve 33 were activated to supply warm water in amounts of 162 ml, 162 ml and 250 ml to color developing tank 1, bleach-fixing tank 2 and third stabilizing tank 5, respectively.

After exposure, the Konica Color Printing Paper type QA was set on the automatic developing machine and processed at 15 $m^2$ daily for 1 month to evaluate the storage stability as rated on prints. The water replenishment setting was such that upon liquid level fall of not less than 10 mm below the preset level in the processing solution, the water replenisher was supplied until the liquid level returned to the preset level.

For comparison, the conventional method was evaluated, in which replenishers were prepared in replenisher tanks and supplied via respective bellows pumps. The replenishers used were prepared by dissolving the tablets for color printing paper described in Example 1 (6 pieces of color developer replenisher, 6 pieces of bleach-fixer replenisher, 5 pieces of stabilizer replenisher) in water and diluted to 1 liter. The amount of replenisher per $m^2$ of color printing paper was 167 ml of color developer replenisher, 167 ml of bleach-fixer replenisher and 200 ml of stabilizer replenisher.

As for water replenishment for compensating the water loss due to evaporation, the setting was such that upon liquid level fall of not less than 10 mm below the preset level, the water replenisher was supplied until the liquid level returned to the preset level.

As in Example 2, photographic performance stability was evaluated by processing the control strip CPK-2 for the top and for every 30 $m^2$ to determine photographic image density, and by sampling the processing solution every 10 days and analyzing the processing solution composition as to the items shown in Table 4.

Tables 4 and 5 show the results of photographic density determination and analytical results for processing solution composition obtained in Example 3.

From the results shown in Tables 4 and 5, it is evident that the inventive processing is stabler than the conventional processing, having less fluctuation in photographic performance and processing solution composition.

TABLE 4

| | Inventive processing | | | | | | | | | Conventional processing | | | | | | | | |
|---|---|---|---|---|---|---|---|---|---|---|---|---|---|---|---|---|---|---|
| | STAIN | | | HD | | | Dmax | | | STAIN | | | HD | | | Dmax | | |
| | B | G | R | B | G | R | B | G | R | B | G | R | B | G | R | B | G | R |
| TOP | 0.05 | 0.04 | 0.03 | 1.60 | 1.62 | 1.55 | 2.30 | 2.47 | 2.54 | 0.06 | 0.05 | 0.04 | 1.60 | 1.62 | 1.55 | 2.30 | 2.47 | 2.54 |
| After 30 $m^2$ processing | 0.05 | 0.04 | 0.03 | 1.60 | 1.62 | 1.55 | 2.30 | 2.47 | 2.55 | 0.06 | 0.05 | 0.04 | 1.60 | 1.62 | 1.55 | 2.30 | 2.47 | 2.54 |
| After 60 $m^2$ processing | 0.05 | 0.04 | 0.03 | 1.60 | 1.61 | 1.55 | 2.31 | 2.47 | 2.55 | 0.06 | 0.05 | 0.04 | 1.60 | 1.62 | 1.55 | 2.30 | 2.47 | 2.54 |
| After 90 $m^2$ processing | 0.05 | 0.04 | 0.03 | 1.60 | 1.61 | 1.55 | 2.31 | 2.48 | 2.55 | 0.06 | 0.05 | 0.04 | 1.60 | 1.62 | 1.55 | 2.31 | 2.47 | 2.55 |
| After 120 $m^2$ processing | 0.05 | 0.04 | 0.03 | 1.60 | 1.61 | 1.55 | 2.31 | 2.48 | 2.55 | 0.05 | 0.06 | 0.04 | 1.60 | 1.62 | 1.56 | 2.31 | 2.48 | 2.55 |
| After 150 $m^2$ processing | 0.05 | 0.04 | 0.03 | 1.60 | 1.61 | 1.55 | 2.30 | 2.48 | 2.55 | 0.07 | 0.06 | 0.05 | 1.61 | 1.63 | 1.56 | 2.32 | 2.48 | 2.55 |
| After 180 $m^2$ processing | 0.06 | 0.04 | 0.03 | 1.60 | 1.62 | 1.56 | 2.30 | 2.47 | 2.54 | 0.07 | 0.05 | 0.05 | 1.61 | 1.63 | 1.56 | 2.32 | 2.49 | 2.56 |
| After 210 $m^2$ processing | 0.06 | 0.04 | 0.03 | 1.60 | 1.62 | 1.56 | 2.32 | 2.48 | 2.55 | 0.07 | 0.06 | 0.05 | 1.61 | 1.63 | 1.56 | 2.32 | 2.49 | 2.56 |
| After 240 $m^2$ processing | 0.06 | 0.04 | 0.03 | 1.60 | 1.62 | 1.56 | 2.32 | 2.48 | 2.55 | 0.07 | 0.06 | 0.05 | 1.62 | 1.63 | 1.57 | 2.33 | 2.49 | 2.56 |
| After 270 $m^2$ processing | 0.05 | 0.04 | 0.03 | 1.60 | 1.62 | 1.55 | 2.30 | 2.47 | 2.54 | 0.08 | 0.06 | 0.05 | 1.62 | 1.64 | 1.57 | 2.34 | 2.49 | 2.57 |
| After 300 $m^2$ processing | 0.06 | 0.04 | 0.03 | 1.60 | 1.62 | 1.55 | 2.30 | 2.47 | 2.54 | 0.08 | 0.07 | 0.06 | 1.62 | 1.64 | 1.57 | 2.34 | 2.50 | 2.57 |
| After 330 $m^2$ processing | 0.05 | 0.04 | 0.03 | 1.60 | 1.62 | 1.55 | 2.31 | 2.47 | 2.54 | 0.08 | 0.07 | 0.06 | 1.62 | 1.64 | 1.57 | 2.35 | 2.50 | 2.57 |
| After 360 $m^2$ processing | 0.05 | 0.04 | 0.03 | 1.60 | 1.62 | 1.56 | 2.30 | 2.46 | 2.53 | 0.08 | 0.07 | 0.06 | 1.63 | 1.65 | 1.58 | 2.35 | 2.51 | 2.58 |
| After 390 $m^2$ processing | 0.06 | 0.04 | 0.03 | 1.61 | 1.62 | 1.56 | 2.31 | 2.47 | 2.54 | 0.08 | 0.07 | 0.06 | 1.63 | 1.65 | 1.58 | 2.36 | 2.51 | 2.58 |

TABLE 4-continued

| | Inventive processing | | | | | | | | | Conventional processing | | | | | | | | |
|---|---|---|---|---|---|---|---|---|---|---|---|---|---|---|---|---|---|---|
| | STAIN | | | HD | | | Dmax | | | STAIN | | | HD | | | Dmax | | |
| | B | G | R | B | G | R | B | G | R | B | G | R | B | G | R | B | G | R |
| After 420 $m^2$ processing | 0.06 | 0.04 | 0.03 | 1.60 | 1.62 | 1.56 | 2.31 | 2.47 | 2.54 | 0.08 | 0.07 | 0.06 | 1.63 | 1.66 | 1.59 | 2.36 | 2.52 | 2.58 |
| After 450 $m^2$ processing | 0.06 | 0.04 | 0.03 | 1.60 | 1.62 | 1.56 | 2.31 | 2.47 | 2.54 | 0.08 | 0.07 | 0.06 | 1.63 | 1.66 | 1.59 | 2.36 | 2.52 | 2.58 |

STAIN indicates minimum density; HD, shoulder density; Dmax, maximum density; B, blue filter density; G, green filter density; and R, red filter density.

TABLE 5

| | CD | | | | BF | | | | STAB* |
|---|---|---|---|---|---|---|---|---|---|
| | pH | Specific gravity | KCL | CD-3 | pH | Specific gravity | $(NH_4)_2S_2O_3$ | $(NH_4)_2SO_3$ | Specific gravity |
| | | | | | (1/2) Inventive processing | | | | |
| TOP | 10.00 | 1.031 | 4.00 | 4.50 | 7.00 | 1.090 | 85.0 | 20.0 | 1.003 |
| After 150 $m^2$ processing | 10.00 | 1.032 | 4.00 | 4.47 | 7.10 | 1.090 | 87.0 | 18.0 | 1.000 |
| After 200 $m^2$ processing | 10.00 | 1.032 | 4.02 | 4.48 | 7.15 | 1.091 | 87.0 | 17.0 | 1.013 |
| After 450 $m^2$ processing | 10.00 | 1.033 | 4.02 | 4.48 | 7.20 | 1.091 | 88.0 | 16.0 | 1.017 |
| | | | | | (2/2) Conventional processing | | | | |
| TOP | 10.00 | 1.031 | 4.00 | 4.50 | 7.00 | 1.090 | 85.0 | 20.0 | 1.003 |
| After 150 m2 processing | 9.99 | 1.033 | 4.20 | 4.50 | 7.13 | 1.093 | 89.0 | 14.2 | 1.011 |
| After 200 m2 processing | 9.98 | 1.035 | 4.32 | 4.70 | 7.18 | 1.098 | 93.0 | 11.5 | 1.018 |
| After 450 m2 processing | 9.97 | 1.037 | 4.38 | 4.80 | 7.25 | 1.100 | 97.0 | 9.8 | 1.025 |

*STAB indicates the measurement for the first tank
CD, color developer; BF, bleach-fixer; STAB, stabilizer; KCl, Potassium chloride; CD-3, color developing agent; $(NH_4)_2S_2O_3$, ammonium thiosulfate; and $(NH_4)_2SO_3$, ammonium sulfite.

EXAMPLE 4

In addition to color developer replenisher for color negative films 1 and color developer replenisher for color printing paper 5, both prepared in Example 1, the following replenishers were prepared as follows.

8) Color Developer Replenisher for Color Negative Films 3.0 g of hydroxylamine sulfate, 6.0 g of the developing agent CD-4 [4-amino-3-methyl-N-ethyl-N-β-hydroxylethyl)aniline sulfate],2.5 g of sodium 1-hydroxyethane-1,1-diphosphonate, 3.50 g of sodium sulfite, 30.8 g of potassium carbonate, 1.50 g of sodium hydrogen carbonate, 0.70 g of sodium bromide and 2.0 g of sodium diethylenetriaminepentaacetate were milled in the same manner as in procedure 1 and then uniformly mixed in a commercially available mixer, after which they were solidified under a compressive pressure of 800 kg/$cm^2$ in a room conditioned at 25° C. and under 40% RH, using a solid processing agent tableting machine, a modification of Tough Press Correct 1527HU, produced by Kikusui Seisakusho. A total of 10 pieces of solid color developing agent for color negative films were prepared in the same manner as in Example 4.

9) Color Developer Replenisher for Color Negative Films

A solid processing agent was prepared in the same manner as in 8 above except that uniform mixing in a commercially available mixing machine was followed by granulation with the amount of water sprayed set at 11.65 ml, after which the granulation product was dried at 70° C. for 15 minutes and then further dried at 40° C. in a vacuum for 2 hours to remove almost all the water from the granulation product.

10) Color Developer Replenisher for Color Printing Paper 4.8 g of diethylhydroxylamine oxalate, 1.32 g of sodium hydrogen carbonate, 6.48 g of the developing agent CD-3 [1-(N-ethyl-N-methanesulfonamidoethyl)-3-methyl-p-phenylenediamine sesquisulfate monohydrate, 0.144 g of sodium sulfite, 21.6 g of potassium carbonate, 10.8 g of sodium hydrogen carbonate, 1.8 g of Tinopal SFP, 2.88 g of sodium diethylenetriaminepentaacetate and 1.44 g of Pullulonic F-68 (produced by Asahi Denka Kogyo) were granulated in the same manner as procedure 1 and then treated in the same manner as in 8 above to yield 6 pieces of a solid color developing agent for color printing paper.

11) Color Developer Replenisher for Color Printing Paper

A solid processing agent was prepared in the same manner as in 10 above except that uniform mixing in a commercially available mixing machine was followed by granulation with the amount of water sprayed set at 6.96 ml.

The tablets thus obtained were placed in glass bottles and stored at 70° C. for 1 month, after which the contents of CD-3, CD-4, hydroxylamine and diethylhydroxylamine were determined and expressed as percent residual rates relative to the values obtained before storage.

Solubility was also observed macroscopically.

The results are shown in Tables 6 and 7.

TABLE 6

| (Color developer replenisher for color negative films) | | |
|---|---|---|
| Sample No. | CD-4 residual rate (%) | Hydroxylamine residual rate (%) |
| 8) | 75 | 63 |
| 1) | 98 | 96 |

TABLE 6-continued (Color developer replenisher for color negative films)

| Sample No. | CD-4 residual rate (%) | Hydroxylamine residual rate (%) |
|---|---|---|
| 9) | 91 | 90 |

TABLE 7

(Color developer replenisher for color printing paper)

| Sample No. | CD-3 residual rate (%) | Diethylhydroxylamine residual rate (%) |
|---|---|---|
| 10) | 78 | 75 |
| 5) | 99 | 97 |
| 11) | 92 | 90 |

As seen from the results shown in Tables 6 and 7, storage stability improves when granulation is followed by tableting in the present invention. The results also reveal that storage stability further improves when tableting is conducted after granulation in separate portions as with replenishers 1 and 5 above.

Observation of solubility revealed that replenishers 1 and 5 ranked highest in dissolution speed, followed by replenishers 9 and 11. Separate granulation after granulation is preferable also from the viewpoint of solubility.

EXAMPLE 5

A solid processing agent was prepared in the same manner as with replenisher 5 above except that diethylhydroxylamine oxalate in the color developer replenisher for color printing paper in Example 1 was replaced by the same molar amount of a compound listed in Table 8. This solid processing agent was placed in a glass bottle and stored at 80° C. for 2 months, after which the preservative content was determined and expressed as percent residual rate relative to the value obtained before storage. For comparison, the same solid processing agent was dissolved in the same manner as in Example 1 to yield a solution, which was used as the comparative sample.

Also, to determine the strength of the solid processing agent after storage, a free fall test was conducted wherein the solid processing agent was dropped for a height of 50 m and examined for the state of break.

The results are shown in Table 8.

Evaluation criteria for strength were as follows.

A: No break.
B: Very slight break.
C: Crack or partial break.
D: Considerable break.
E: Crush.

TABLE 8

(Storage stability)

| Compound | Compound residual rate (%) Solid | Liquid | Strength |
|---|---|---|---|
| Hydroxylamine sulfate | 73 | 32 | C |
| Glucose | 58 | 23 | D |
| D-glucosamine hydrochloride | 65 | 35 | C |
| Aminomethanesulfonic acid | 40 | 5 | D |
| Triethanolamine hydrochloride | 79 | 42 | C |
| Monoethanolamine hydrochloride | 74 | 37 | C |
| Diethylhydroxylamine oxalate | 93 | 43 | B |
| Dimethoxyethylhydroxylamine oxalate | 95 | 48 | A |
| Hydrazinodiacetic acid | 95 | 45 | A |
| Bis(sulfoethyl)hydroxylamine | 97 | 45 | A |

TABLE 8-continued (Storage stability)

| Compound | Compound residual rate (%) Solid | Liquid | Strength |
|---|---|---|---|
| Bis(carboxyl)ethylhydroxylamine | 92 | 41 | A |

EXAMPLE 6

Using a ferric salt listed in Table 11 in place of ammonium ferric 1,3-propylenediaminetetraacetate in the same molar amount used in the color negative film bleacher in Example 1, the degree of generation of divalent Fe ions was determined after tight sealing storage in glass bottles at 80° C. for 2 months, and strength against fall was also determined in the same manner as in Example 5. The results are shown in Table 9.

TABLE 9

| Ferric complex salt of organic acid | $Fe^{++}$ generation rate (%) | Strength |
|---|---|---|
| Ammonium ferric ethylenediaminetetraacetate | 14% | C |
| Ammonium ferric hydroxyethyliminodiacetate | 23% | D |
| Ammonium ferric diethylenetriaminetetraacetate | 17% | C |
| Ammonium ferric nitrilotriacetate | 19% | C |
| C-1 | 3% | A |
| C-6 | 2% | A |
| C-12 | 2% | A |

As seen from Table 9, the use of an organic acid ferric complex salt of formula C offers a lower $Fe^{++}$generation rate and good strength against fall.

What is claimed is:

1. An automatic processing machine for a light-sensitive silver halide photogrpahic material, comprising:

a processing tank for containing a processing solution;

stocking means for stocking a solid processing agent;

supplying means for supplying said solid processing agent to said processing tank;

detecting means for detecting information as to the amount of processing of said light-sensitive silver halide photographic material;

control means for controlling said supplying means according to said information as to the amount of processing of said light-sensitive silver halide photographic material, to control the supplying of said solid processing agent to said processing tanks; and filtering means for filtering an insoluble substance from said solid processing agent to prevent flaws on said light-sensitive silver halide photographic material.

2. The automatic processing machine of claim 1, wherein said stocking means is formed integrally with said supplying means.

3. The automatic processing machine of claim 1, wherein said solid processing agent comprises a plurality of tablets.

4. An automatic processing machine for a light-sensitive silver halide photographic material, comprising:

a plurality of processing tanks, each processing tank being arranged for containing a processing solution;

stocking means for stocking a solid processing agent;

supplying means for supplying said solid processing agent to at least one of said processing tanks;

detecting means for detecting information as to the amount of processing of said light-sensitive silver halide photographic material; and control means for controlling said supplying means according to said information as to the amount of processing of said light-sensitive silver halide photographic material, to control the supplying of said solid processing agent to said at least one processing tank;

and wherein:

said plurality of processing tanks include a developing tank and a bleach-fixing tank;

each of said developing tank and said bleach-fixing tank includes said stocking means and said supplying means; and said control means controls said supplying means of each of said developing tank and said bleach-fixing tank.

5. The automatic processing machine of claim 4, wherein said stocking means is formed integrally with said supplying means.

6. The automatic processing machine of claim 4, wherein said solid processing agent comprises a plurality of tablets.

7. The automatic processing machine of claim 6, wherein said control means is a common controller which controls both said supplying means of said developing tank and said supplying means of said bleach-fixing tank.

8. The automatic processing machine of claim 7, wherein said stocking means of each of said tanks is formed integrally with said supplying means of the respective tank.

9. The automatic processing machine of claim 4, wherein said control means is a common controller which controls both said supplying means of said developing tank and said supplying means of said bleach-fixing tank.

10. The automatic processing machine of claim 9, wherein said stocking means of each of said tanks is formed integrally with said supplying means of the respective tank.

11. The automatic processing machine of claim 9, wherein said solid processing agent comprises a plurality of tablets.

12. The automatic processing machine of claim 4, wherein each of said developing tank and said bleach-fixing tank comprises:

a processing portion for processing said light-sensitive silver halide photographic material;

a receiving portion for receiving said solid processing agent; and means for circulating said processing solution between said processing portion and said receiving portion.

13. An automatic processing machine for a light-sensitive silver halide photographic material, comprising:

a plurality of processing tanks, each processing tank being arranged for containing a processing solution;

stocking means for stocking a solid processing agent;

supplying means for supplying said solid processing agent to at least one of said processing tanks;

detecting means for detecting information as to the amount of processing of said light-sensitive silver halide photographic material; and control means for controlling said supplying means according to said information as to the amount of processing of said light-sensitive silver halide photographic material, to control the supplying of said solid processing agent to said at least one processing tank;

and wherein:

said plurality of processing tanks include a developing tank, a bleaching tank and a fixing tank;

each of said developing tank, said bleaching tank and said fixing tank includes said stocking means and said supplying means; and said control means controls said supplying means of each of said developing tank, said bleaching tank and said fixing tank.

14. The automatic processing machine of claim 13, wherein said stocking means is formed integrally with said supplying means.

15. The automatic processing machine of claim 13, wherein said solid processing agent comprises a plurality of tablets.

16. The automatic processing machine of claim 13, wherein said control means is a common controller which controls each of said supplying means of said developing tank, said supplying means of said bleaching tank and said supplying means of said fixing tank.

17. The automatic processing machine of claim 16, wherein said stocking means of each of said tanks is formed integrally with said supplying means of the respective tank.

18. The automatic processing machine of claim 16, wherein said solid processing agent comprises a plurality of tablets.

19. The automatic processing machine of claim 13, wherein each of said developing tank, said bleaching tank and said fixing tank comprises:

a processing portion for processing said light-sensitive silver halide photographic material;

a receiving portion for receiving said solid processing agent; and means for circulating said processing solution between said processing portion and said receiving portion.

20. An automatic processing machine for a light-sensitive silver halide photographic material, comprising:

a processing tank for containing a processing solution;

stocking means for stocking a solid processing agent;

supplying means for supplying a solid processing agent to said processing tank;

detecting means for detecting information as to the amount of processing of said light-sensitive silver halide photographic material;

control means for controlling said supplying means according to said information as to the amount of processing of said light-sensitive silver halide photographic material, to control the supplying of said solid processing agent to said processing tank; and water supply means for supplying a water replenisher to said processing tank; and wherein said processing tank comprises a processing portion for processing said light-sensitive silver halide photographic material, a receiving portion for receiving said solid processing agent, and means for circulating said processing solution between said processing portion and said receiving portion.

21. The automatic processing machine of claim 20, wherein said stocking means is formed integrally with said supplying means.

22. The automatic processing machine of claim 20, wherein said solid processing agent comprises a plurality of tablets.

23. An automatic processing machine for a light-sensitive silver halide photographic material, comprising:

a plurality of processing tanks, each processing tank being arranged for containing a processing solution;

stocking means for stocking a solid processing agent;

supplying means for supplying said solid processing agent to at least one of said processing tanks;

detecting means for detecting information as to the amount of processing of said light-sensitive silver halide photographic material;

control means for controlling said supplying means according to said information as to the amount of processing of said light-sensitive silver halide photographic material, to control the supplying of said solid processing agent to said at least one processing tank; and water supply means for supplying a water replenisher to said at least one processing tank;

and wherein:

said plurality of processing tanks include a developing tank, a bleaching tank and a fixing tank;

each of said developing tank, said bleaching tank and said fixing tank includes said stocking means and said supplying means; and said control means controls said supplying means of each of said developing tank, said bleaching tank and said fixing tank.

24. The automatic processing machine of claim 23, wherein said stocking means is formed integrally with said supplying means.

25. The automatic processing machine of claim 23, wherein said solid processing agent comprises a plurality of tablets.

26. The automatic processing machine of claim 23, wherein said control means is a common controller which controls each of said supplying means of said developing tank, said supplying means of said bleaching tank and said supplying means of said fixing tank.

27. The automatic processing machine of claim 26, wherein said stocking means of each of said tanks is formed integrally with said supplying means of the respective tank.

28. The automatic processing machine of claim 23, wherein each of said developing tank, said bleaching tank and said fixing tank comprises:

a processing portion for processing said light-sensitive silver halide photographic material;

a receiving portion for receiving said solid processing agent; and means for circulating said processing solution between said processing portion and said receiving portion.

29. An automatic processing machine for a light-sensitive silver halide photographic material, comprising:

a plurality of processing tanks, each processing tank being arranged for containing a processing solution;

stocking means for stocking a solid processing agent;

supplying means for supplying said solid processing agent to at least one of said processing tanks;

detecting means for detecting information as to the amount of processing of said light-sensitive silver halide photographic material;

control means for controlling said supplying means according to said information as to the amount of processing of said light-sensitive silver halide photographic material, to control the supplying of said solid processing agent to said at least one processing tank; and water supply means for supplying a water replenisher to said processing tank;

and wherein:

said plurality of processing tanks include a developing tank and a bleach-fixing tank;

each of said developing tank and said bleach-fixing tank includes said stocking means and said supplying means and said control means controls said supplying means of each of said developing tank and said bleach-fixing tank.

30. The automatic processing machine of claim 29, wherein said stocking means is formed integrally with said supplying means.

31. The automatic processing machine of claim 29, wherein said solid processing agent comprises a plurality of tablets.

32. The automatic processing machine of claim 29, wherein each of said developing tank and said bleach-fixing-tank comprises:

a process portion for processing said light-sensitive silver halide photographic material; a receiving portion for receiving said solid processing agent; and means for circulating said processing solution between said processing portion and said receiving portion.

33. An automatic processing machine for a light-sensitive silver halide photographic material comprising:

a processing tank for containing a processing solution;

stocking means for stocking a solid processing agent;

supplying means for supplying said solid processing agent to said processing tank;

detecting means for detecting information as to the amount of processing of said light-sensitive silver halide photographic material;

control means for controlling said supplying means according to said information as to the amount of processing of said light-sensitive silver halide photographic material, to control the supplying of said solid processing agent to said processing tank;

water supply means for supplying a water replenisher to said processing tank; and filtering means for filtering an insoluble substance from said solid processing agent to prevent flaws on said light-sensitive silver halide photographic material.

34. The automatic processing machine of claim 33, wherein said solid processing agent comprises a plurality of tablets.

35. The automatic processing machine of claim 33, wherein said stocking means is formed integrally with said supplying means.

* * * * *